US006675396B2

(12) United States Patent
Varanasi et al.

(10) Patent No.: US 6,675,396 B2
(45) Date of Patent: Jan. 13, 2004

(54) LIQUID DISPENSING TOILET BOWL CLEANER

(75) Inventors: Padma Prabodh Varanasi, Racine, WI (US); Kevin Harrity, Oak Creek, WI (US); Stephen B. Leonard, Franksville, WI (US); Timothy I Moodycliffe, Milwaukee, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 22 days.

(21) Appl. No.: 10/149,856

(22) PCT Filed: Dec. 13, 2000

(86) PCT No.: PCT/US00/33756

§ 371 (c)(1),
(2), (4) Date: Jun. 13, 2002

(87) PCT Pub. No.: WO01/44591

PCT Pub. Date: Jun. 21, 2001

(65) Prior Publication Data

US 2002/0178493 A1 Dec. 5, 2002

Related U.S. Application Data

(63) Continuation-in-part of application No. 09/614,873, filed on Jul. 12, 2000, now Pat. No. 6,412,120, which is a continuation-in-part of application No. 09/460,570, filed on Dec. 14, 1999, now Pat. No. 6,178,564.

(51) Int. Cl.[7] ..... E03D 9/02
(52) U.S. Cl. ..... 4/223; 4/231
(58) Field of Search ..... 4/223, 231, 224, 4/227.1, 227.4, 227.5, 227.6, 230; 222/88, 90, 83.5

(56) References Cited

U.S. PATENT DOCUMENTS

| | | | |
|---|---|---|---|
| 597,811 | A | 1/1898 | Calkins |
| 681,100 | A | 8/1901 | Calkins |
| RE13,551 | E | 4/1913 | Williams et al. |
| 1,067,472 | A | 7/1913 | Creed |

(List continued on next page.)

FOREIGN PATENT DOCUMENTS

| | | | |
|---|---|---|---|
| CA | 1130763 | | 8/1982 |
| DE | 1286972 | | 1/1969 |
| DE | 2523849 | | 12/1975 |
| DE | 8902509 | U1 | 10/1989 |
| DE | 4236037 | A1 | 4/1994 |
| EP | 0538957 | A1 | 7/1993 |
| EP | 0785315 | A1 | 7/1997 |
| EP | 0878586 | A2 | 11/1998 |

(List continued on next page.)

*Primary Examiner*—Gregory Huson
*Assistant Examiner*—Khoa D Huynh

(57) ABSTRACT

A liquid dispenser for dispensing a liquid from the rim of a toilet bowl such that a controlled, consistent amount of liquid is dispensed into each flush. The liquid dispenser includes a bottle for holding the liquid, a base for holding the bottle and for providing a liquid feed conduit between the bottle and a dispensing plate, and a hook for suspending the base from the rim of the toilet bowl. The dispensing plate is integral with or attached to the base, downwardly inclined at an angle of from about 10 to about 30 degrees from the horizontal, and serves to distribute liquid from the feed conduit to a dispensing position on the upper surface of the dispensing plate where the liquid is contacted by flushing water from the toilet bowl. The dispensing plate has various configurations that assist in the distribution of the liquid to the dispensing position on the upper surface of the dispensing plate. In a preferred version of the liquid dispenser, the dispensing plate has capillary channels in its upper surface for distributing the liquid, which has a viscosity of from about 2000 to about 4000 centipoise from the feed conduit to the dispensing position, and a plurality of engagement means by which the bottle is held in position, as well a barrier means and openings to control flow of liquid on the surface of the dispensing plate.

35 Claims, 18 Drawing Sheets

U.S. PATENT DOCUMENTS

| | | | | | |
|---|---|---|---|---|---|
| 1,091,265 | A | | 3/1914 | Wholander et al. | |
| 1,880,912 | A | | 10/1932 | Duwelius | |
| 2,075,266 | A | | 3/1937 | Bowman | |
| 2,350,451 | A | * | 6/1944 | Embrey | 222/81 |
| 3,177,502 | A | | 4/1965 | Meunier | |
| 3,529,309 | A | | 9/1970 | Leavitt et al. | |
| 3,537,112 | A | | 11/1970 | Goodman | |
| 3,604,021 | A | | 9/1971 | Nolte | |
| 3,623,941 | A | | 11/1971 | Goodenow | |
| 3,639,070 | A | | 2/1972 | Davidson | |
| 3,675,254 | A | | 7/1972 | Brownstein | |
| 3,736,600 | A | | 6/1973 | Drinkwater | |
| 3,766,576 | A | | 10/1973 | Ancel | |
| 3,806,965 | A | | 4/1974 | Lerner | |
| 3,933,965 | A | | 1/1976 | Gallone et al. | |
| 3,946,448 | A | | 3/1976 | Sioufy | |
| 4,096,593 | A | | 6/1978 | Vlahakis | |
| 4,228,928 | A | | 10/1980 | Hocker et al. | |
| 4,261,957 | A | | 4/1981 | Schimanski | |
| 4,301,556 | A | | 11/1981 | Schimanski | |
| 4,349,988 | A | | 9/1982 | Kotula et al. | |
| RE32,017 | E | | 11/1985 | Hautmann et al. | |
| 4,555,819 | A | | 12/1985 | Weiss et al. | |
| 4,722,449 | A | | 2/1988 | Dubach | |
| 4,777,670 | A | | 10/1988 | Klinkhammer et al. | |
| 4,813,084 | A | | 3/1989 | Buecheler et al. | |
| 4,913,350 | A | | 4/1990 | Purzycki | |
| 4,916,760 | A | | 4/1990 | Shahar | |
| 5,186,912 | A | | 2/1993 | Steindorf et al. | |
| 5,261,755 | A | | 11/1993 | Draper et al. | |
| 5,472,143 | A | | 12/1995 | Bartels et al. | |
| 5,547,094 | A | | 8/1996 | Bartels et al. | |
| 5,657,065 | A | | 8/1997 | Lin | |
| 5,901,886 | A | | 5/1999 | Grindstaff et al. | |
| 5,911,851 | A | | 6/1999 | Bartels et al. | |
| 6,178,564 | B1 | * | 1/2001 | Leonard et al. | 4/223 |
| 6,230,334 | B1 | | 5/2001 | Camp et al. | |
| 6,389,610 | B1 | | 5/2002 | Hautmann et al. | |
| 6,412,120 | B1 | * | 7/2002 | Leonard et al. | 4/223 |
| 2001/0004775 | A1 | * | 6/2001 | Falchieri | |

FOREIGN PATENT DOCUMENTS

| | | | |
|---|---|---|---|
| FR | 2647483 | A1 | 11/1990 |
| GB | 296338 | | 8/1928 |
| GB | 2338495 | A | 12/1999 |
| GB | 2338496 | A | 12/1999 |
| WO | WO 90/10122 | A1 | 9/1990 |
| WO | WO 96/11850 | A1 | 4/1996 |
| WO | WO 98/09027 | A1 | 3/1998 |
| WO | WO 99/66139 | A1 | 12/1999 |
| WO | WO 99/66140 | A1 | 12/1999 |
| WO | WO 00/42260 | A1 | 7/2000 |
| WO | WO 00/42261 | A1 | 7/2000 |

* cited by examiner

FIG. 14
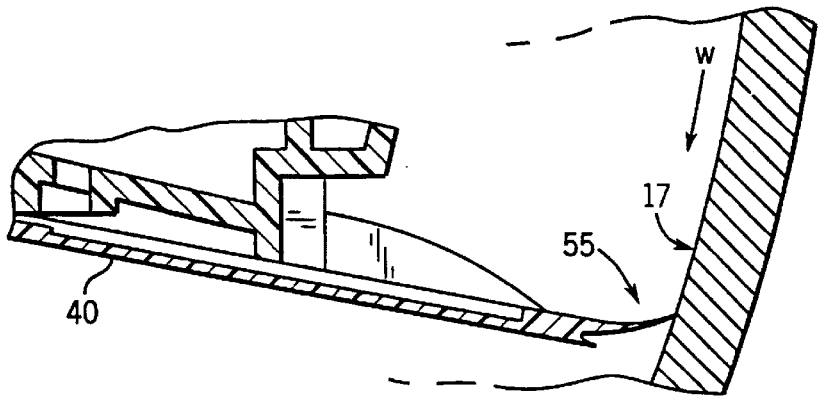
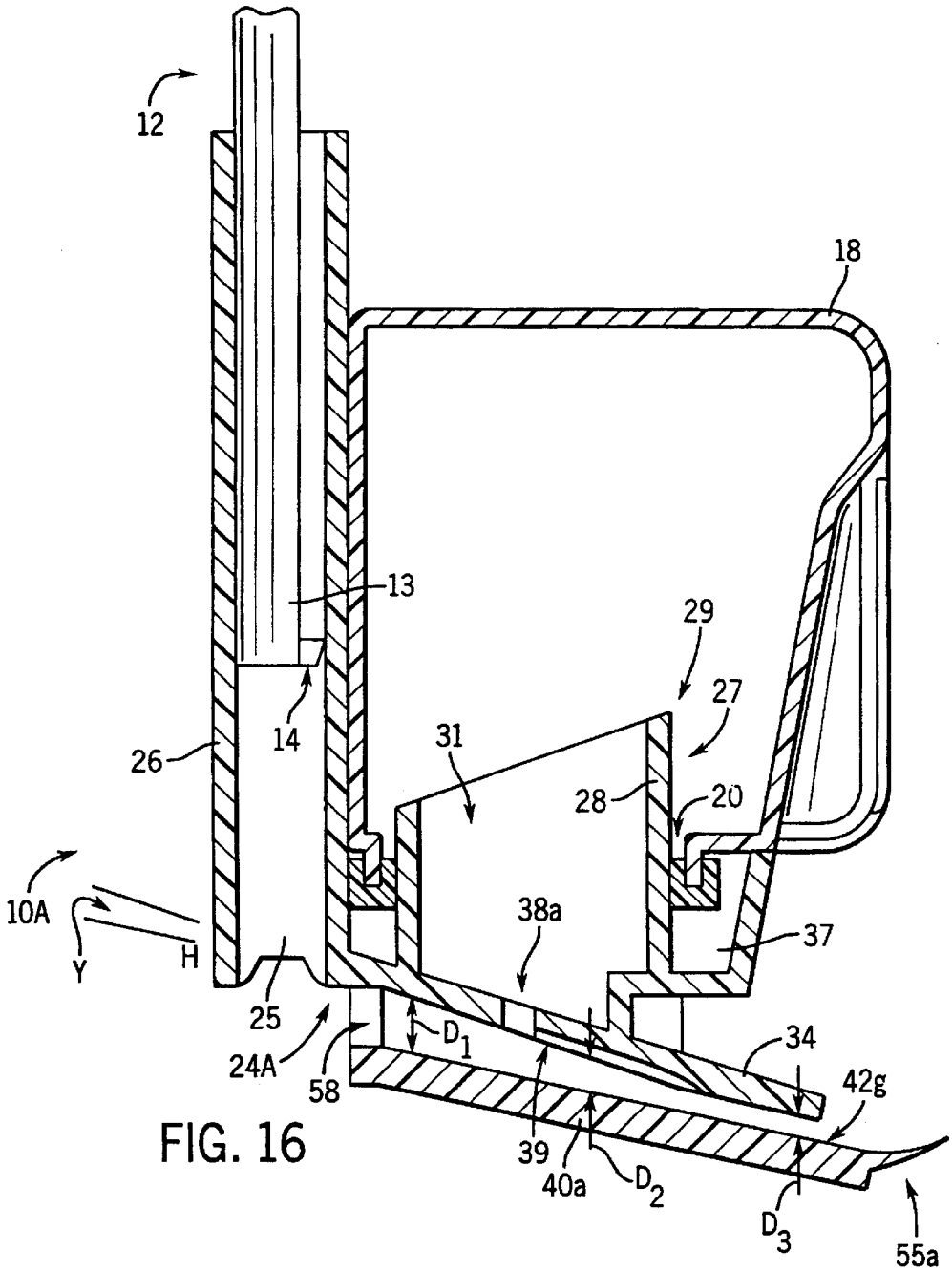
FIG. 16

LIQUID DISPENSING TOILET BOWL CLEANER

CROSS REFERENCES TO RELATED APPLICATIONS

This is a continuation-in-part of application Ser. No. 09/614,873, filed Jul. 12, 2000, now U.S. Pat. No. 6,412,120 which is in turn a continuation-in-part of application Ser. No. 09/460,570, filed Dec. 14, 1999, now U.S. Pat. No. 6,178,564.

STATEMENT REGARDING FEDERALLY SPONSORED RESEARCH

Not applicable.

BACKGROUND OF THE INVENTION

This invention relates to liquid dispensers and in particular to devices for dispensing quantities of liquids, such as cleaning and/or freshening liquids, from under the rim of a toilet bowl.

Toilet bowls require care to prevent the buildup of unsightly deposits, to reduce odors and to prevent bacteria growth. Traditionally, toilet bowls have been cleaned, deodorized and disinfected by manual scrubbing with a liquid or powdered cleaning and sanitizing agent. This task has required manual labor to keep the toilet bowl clean.

In order to eliminate the manual scrubbing, various automatic continuous cleaning toilet bowl cleaning products have been proposed. One type of product comprises a solid block or solid particles of a cleansing and freshening substance that is suspended from the rim of a toilet bowl in a container that is placed in the path of the flushing water. U.S. Pat. No. 3,529,309 shows an example of this type of toilet bowl cleaning system. The solid cleaning blocks have a short lifetime and the release of cleaning and deodorizing agents drops off as the solid block deteriorates.

Toilet cleaning systems that use a liquid cleaning agent have also been developed. For example, European Patent Application EP-0538957 discloses a cleansing and/or freshening unit capable of being suspended from the rim of a toilet bowl for the purpose of introducing liquid active substances from a bottle into the flushing water with each flush. Another similar liquid dispensing toilet bowl cleaning system is described in European Patent Application EP-0785315. This application acknowledges that one problem with the device disclosed in EP-0538957 is that as the liquid level in the dispensing bottle falls, the rate at which liquid is dispensed falls with time.

The dispensing device described in EP-0785315 was developed as a proposed solution to this problem, and includes a dispensing bottle with a structure that permits both the flow of liquid from the bottle and a return flow of air from outside the bottle to inside the bottle.

While the dispensing device disclosed in EP-0785315 provides an alternative to the solid block toilet cleaning systems described above and to the liquid dispensing device disclosed in EP-0785315, it also has disadvantages. For instance, the device described in EP-0875315 requires the use of a porous, liquid-absorbing mass (i.e. a sponge) which always communicates with the cleaning liquid contained in the dispensing bottle and is located in the path of the flushing water of the toilet. This system is unduly expensive to manufacture and cannot provide precise control over the volume of liquids dispensed in the flushing water.

Therefore, there is a need for an improved device that can dispense a liquid cleaning, disinfecting and deodorizing substance into the toilet.

SUMMARY OF THE INVENTION

In accordance with a first aspect of the present invention there is provided a liquid dispensing device as defined in claim 1.

It has now been determined that the release rate of the liquid is influenced significantly by the angle of the dispensing plate with reference to the horizontal, the viscosity of the liquid being dispensed, and the intensity of the flushing action. The dependency of performance of the dispenser on the intensity of flushing action may be lessened by appropriate adjustment of the angle between the dispensing plate and the horizontal, as well as by adjustment of the viscosity of the liquid dispensed.

In a preferred form, the liquid dispenser is suitable for dispensing a liquid from the rim of a toilet bowl. In this form, the suspension means comprise a suspension hook and a guide channel integral with the mounting structure. The suspension hook has an upper end hook portion that is placed over the toilet rim and a lower end that is slidably inserted in the guide channel such that the lower end of the suspension hook engages an inner surface of the guide channel thereby suspending the mounting structure and the bottle under or adjacent the toilet rim. In this preferred form, the upper surface of the dispensing plate has a collecting cavity in fluid communication with the feed conduit of the base and in fluid communication with the plurality of feed channels, and the upper surface of the dispensing plate also has a venting slot in fluid communication with the collecting cavity and an edge of the base. The venting slot permits ambient air to enter the bottle to displace the liquid dispensed from the bottle. The dispensing plate in this preferred form may also include a deflector secured to an edge of the dispensing plate. The deflector is dimensioned so as to be suitable to contact an inner surface of the toilet bowl when the liquid dispenser is installed on the rim of the toilet bowl. When the toilet is flushed, a portion of the flushing water contacts a dispensing position on the upper surface of the dispensing plate thereby washing the liquid into the flush water.

In accordance with a second aspect of the present invention there is provided a device for dispensing a liquid from the rim of a toilet bowl as defined by claim 24.

In a preferred embodiment, the mounting structure also includes a lower plate with extends outwardly from a wall of the piercing post. The dispensing plate is integral with or attached to the mounting structure in spaced apart relationship with the lower plate of the mounting structure, and an upper surface of the dispensing plate receives liquid from the feed conduit. The lower plate and the dispensing plate are suitable to convey the liquid from the feed conduit to a dispensing position on the upper surface of the dispensing plate.

In a preferred form of the second version of the invention, the liquid dispenser is suitable for dispensing a liquid from the rim of a toilet bowl. In this form, the suspension means comprise a suspension hook and a guide channel integral with the base. The suspension hook has an upper end hook portion that is placed over the toilet rim and a lower end that is slidably inserted in the guide channel such that the lower end of the suspension hook engages an inner surface of the guide channel thereby suspending the base and the bottle under or adjacent the toilet rim. In this preferred form, the dispensing plate is suitable to be upwardly inclined with respect to an inner surface of the toilet bowl when the liquid dispenser is installed on the rim of the toilet bowl, and the lower plate is also suitable to be upwardly inclined with respect to an inner surface of the toilet bowl when the liquid dispenser is installed on the rim of the toilet bowl. The spacing between the upper surface of the dispensing plate and the lower plate of the base varies along the length of the dispensing plate such that a first spacing between the edge of the lower plate nearest the inner surface of the toilet bowl and the edge of the dispensing plate nearest the inner surface of the toilet bowl is less than a second spacing between the edge of the lower plate furthest from the inner surface of the toilet bowl and the edge of the dispensing plate furthest from the inner surface of the toilet bowl. The dispensing plate may also include a deflector secured to an edge of the dispensing plate. The deflector is dimensioned so as to be suitable to contact an inner surface of the toilet bowl when the liquid dispenser is installed on the rim of the toilet bowl. When the toilet is flushed, a portion of the flushing water contacts a dispensing position on the upper surface of the dispensing plate thereby washing the liquid into the flush water.

In both versions of the invention, the base holds the bottle such that the bottle is supported in an inverted position with the mouth of the bottle projecting downwardly such that the liquid can be dispensed from the bottle by gravity. Preferably, the bottle is shallow and compact to minimize the head space in the bottle. When the bottle is filled with liquid, negative pressure or a vacuum (i.e., an equilibrium pressure) exists in the head space in the bottle. After installation of the bottle on the base, a portion of the liquid from the bottle flows onto a dispensing position on the dispensing plate. When flush water washes the liquid from the dispensing position on the dispensing plate, further liquid is dispensed from the bottle and ambient air passes into the bottle to displace the liquid dispensed from the bottle. The volume of ambient air passing into the bottle may be controlled by venting slots or conduits on or adjacent the dispensing plate. In this manner, ambient air can act as a meter that allows for a linear and consistent release of liquid formula by assuring that the pressure in the bottle returns to equilibrium pressure after each flush.

The present invention provides a significant improvement over prior liquid dispensing devices, such as those disclosed in EP-0538957 and EP-0785315, wherein a sponge or similar porous absorbent material was placed in the fluid path of the liquid to prevent the liquid from quickly flowing out of an inverted bottle. As detailed above, the use of a porous mass in these prior liquid dispensing devices did not allow for precise control over the volume of liquids dispensed in the flushing water due to the variability in the manufacturing of the porous medium.

It is an advantage of the present invention to provide a liquid dispensing device that can convey liquid from a liquid reservoir to a dispensing position on a dispensing plate in a controlled consistent manner. More particularly, it is an advantage of the invention to provide a liquid dispenser for dispensing a liquid from the rim of a toilet bowl such that a controlled, consistent amount of liquid is dispensed into each flush.

These and other features, aspects, and advantages of the present invention will become better understood upon consideration of the following detailed description, appended claims and accompanying drawings.

BRIEF DESCRIPTION OF THE DRAWINGS

FIG. 14 is an enlarged partial sectional side view of a liquid dispensing device in accordance with the invention installed on a toilet bowl;

FIG. 16 is cross-sectional view of another embodiment;

DETAILED DESCRIPTION OF THE INVENTION

Referring first to FIGS. 1–9, there is shown a liquid dispenser 10 for dispensing a liquid from the rim of a toilet bowl. The liquid dispenser 10 includes a bottle 18 for holding a liquid, a base 24 for holding the bottle 18, and a suspension hook 12 for suspending the base 24 and the bottle 18 from the rim of a toilet.

Figure 7:
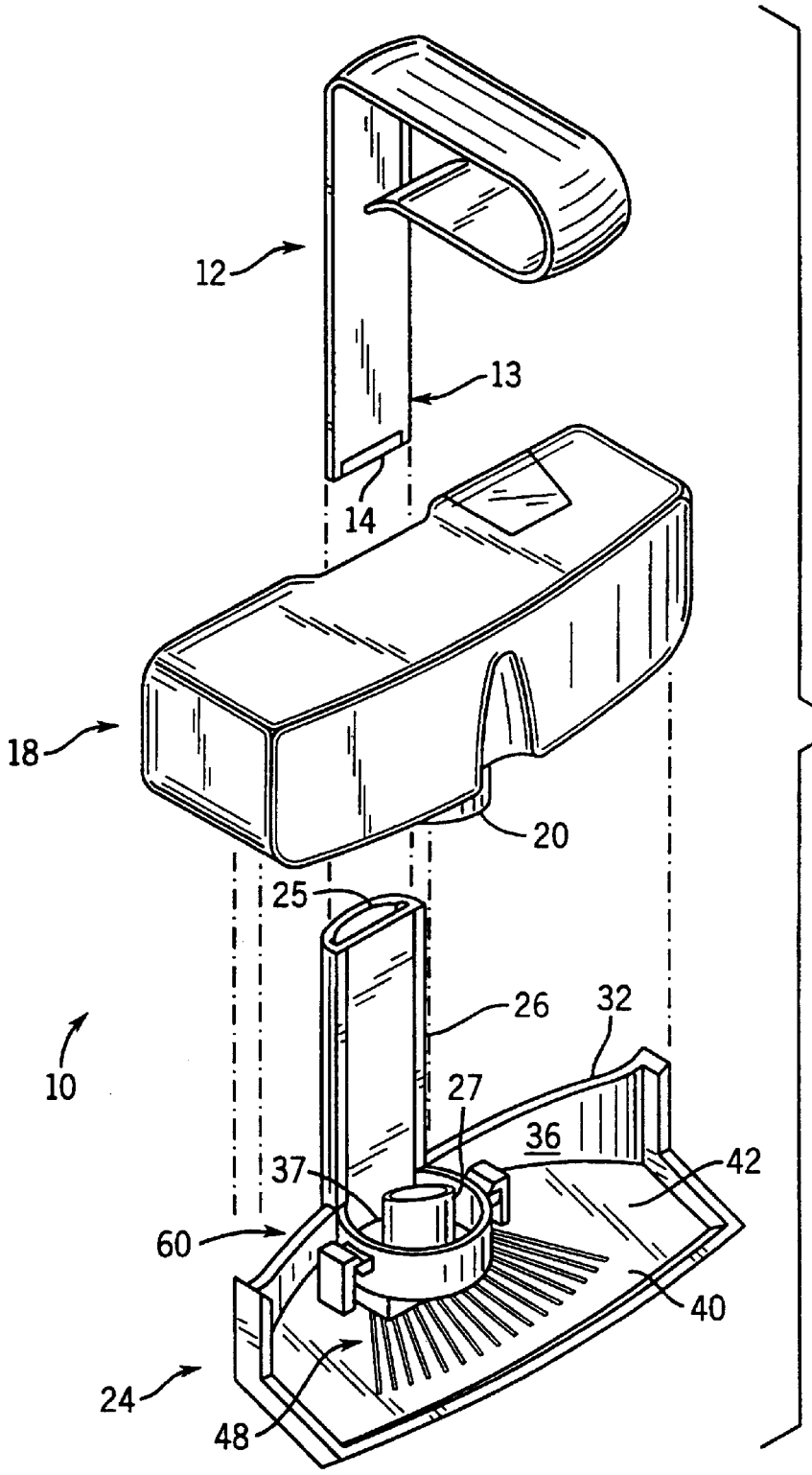
FIG. 7 is an exploded view showing the components of a liquid dispensing device.

For ease of manufacture, the suspension hook 12, the bottle 18 and the base 24 are formed as separate components as shown in FIG. 7. While a variety of materials may be used to form the suspension hook 12, the bottle 18 and the base 24, it is preferable to manufacture these components from an opaque thermoplastic material such as pigmented polyethylene or polypropylene. The liquid used in the dispenser may be any liquid formula having the cleaning, foaming, disinfecting and fragrancing characteristics required for the specific toilet cleaning application.

Figure 1:
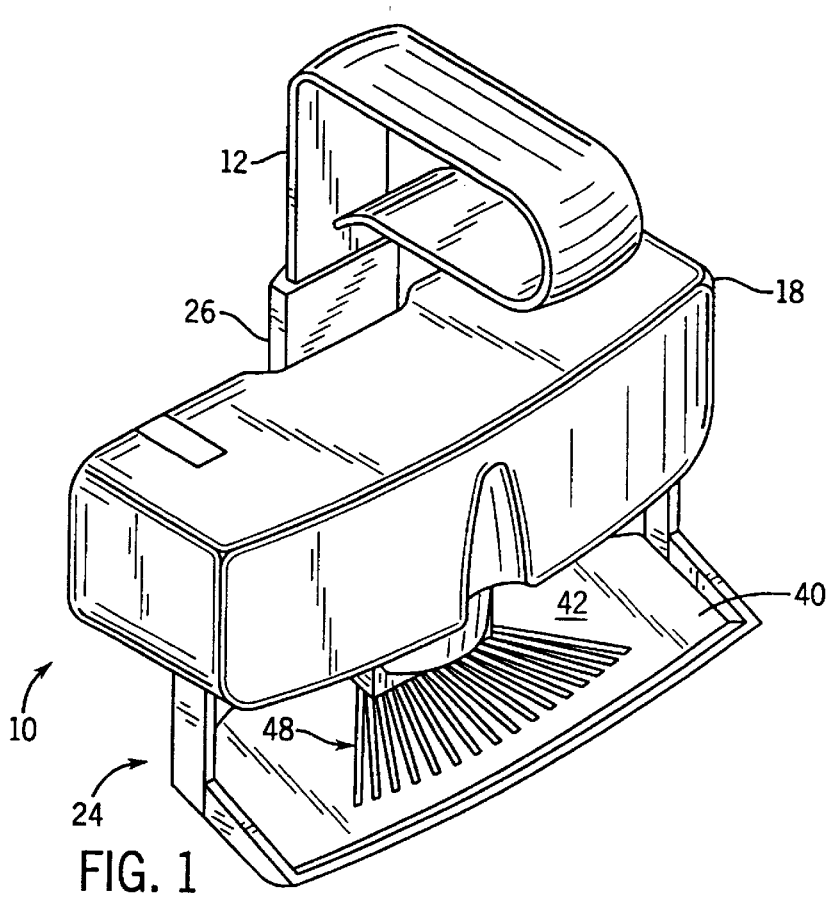
FIG. 1 is a perspective view of a liquid dispensing device in accordance with the invention.
Figure 3:
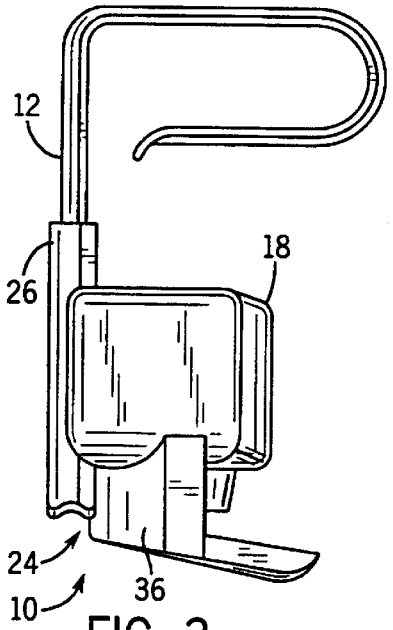
FIG. 3 is a right side elevational view of a liquid dispensing device in accordance with the invention, the left side being the mirror image thereof.
Figure 2:
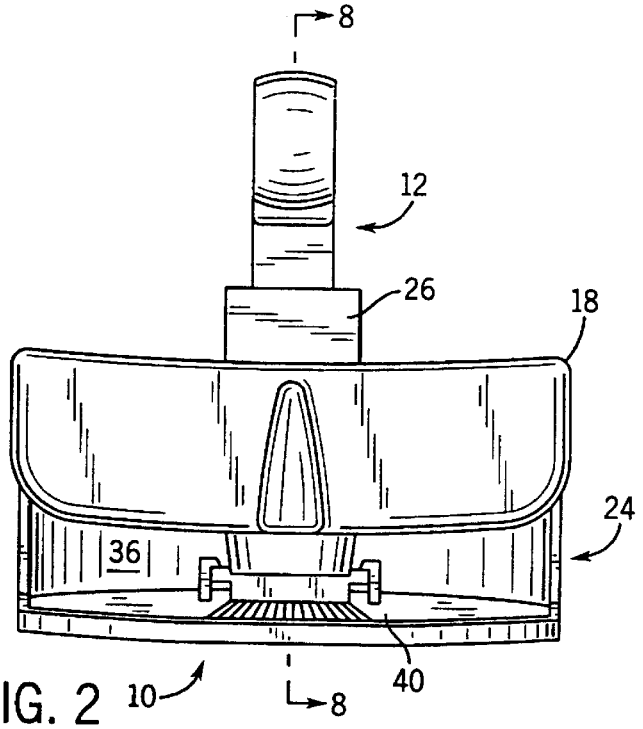
FIG. 2 is a front, elevational view of a liquid dispensing device in accordance with the invention.
Figure 4:
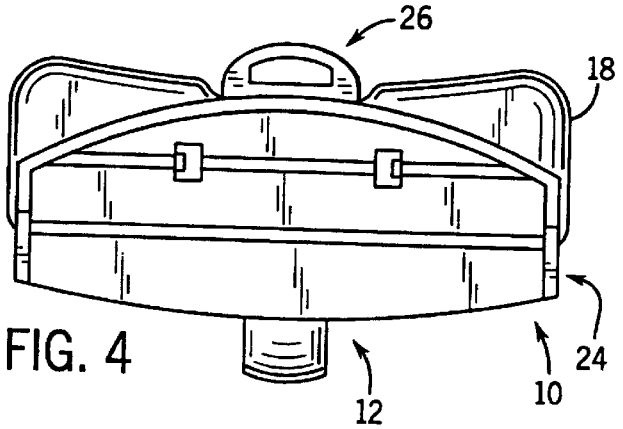
FIG. 4 is a bottom view of a liquid dispensing device in accordance with the invention.
Figure 5:
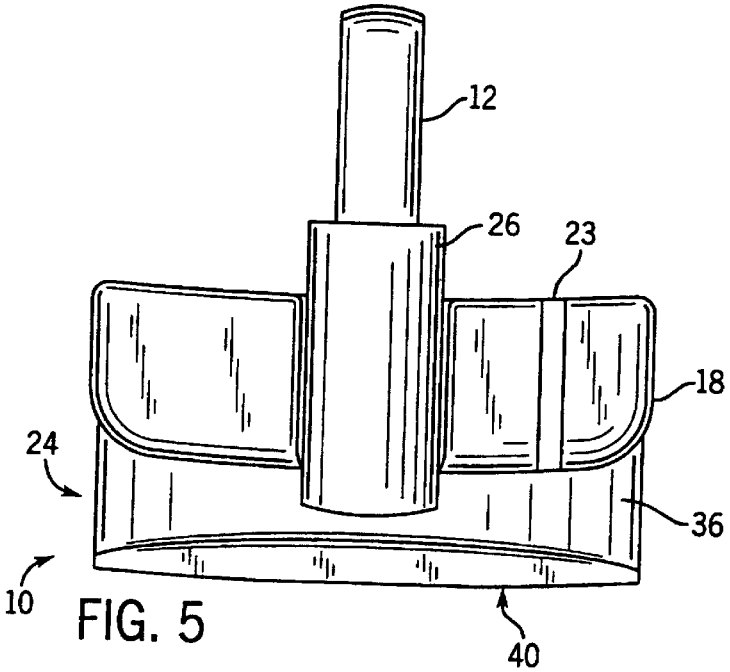
FIG. 5 is a rear view of a liquid dispensing device in accordance with the invention.
Figure 6:
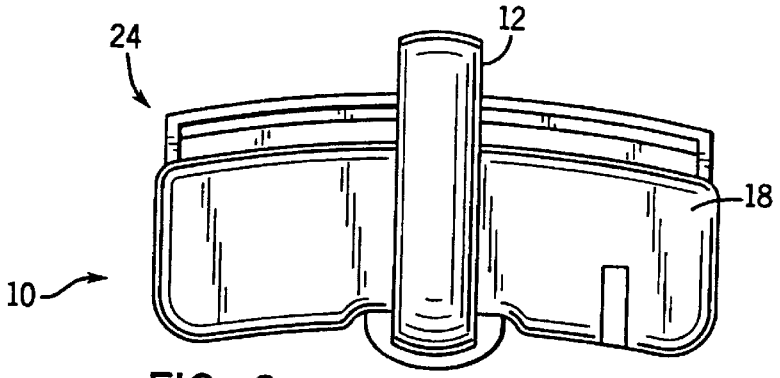
FIG. 6 is a top view of a liquid dispensing device in accordance with the invention.

In a preferred form of the bottle 18 shown in FIG. 5, the bottle 18 includes a clear or transparent view stripe 23 that extends vertically on a portion of the otherwise opaque bottle 18. The clear view stripe 23 allows the user to see the remaining level of liquid in the bottle 18. In one preferred form, the bottle 18 is loaded with approximately 45 milliliters of liquid formula before the device is hooked on the rim.

The base 24 includes an integral elongated upright member 26 that has a guide channel 25 that extends the length of the upright member 26. The suspension hook 12 is inserted into the guide channel 25 when the base 24 and bottle 18 are installed on a toilet rim. A lower end 13 of the suspension hook 12 includes a tab portion 14 that engages the inner surface of the guide channel 25 in a press fit arrangement upon insertion of the suspension hook 12 into the guide channel 25 such that the suspension hook 12 remains attached to the base 24. It can be appreciated that the telescoping arrangement of the guide channel 25 and the suspension hook 12 allows the liquid dispenser 10 to fit the wide variety of toilet rim configurations.

The base 24 also includes a rear wall 36 that terminates at an upper edge 32. The rear wall 36 and the upper edge 32 create a mounting structure 60 that supports the bottle 18 when the bottle 18 is installed on the base 24. On a central portion of the mounting structure 60, as seen in FIG. 7, there is provided an annular channel 37 that surrounds a piercing post 27 that is used to carry fluids from the bottle 18 when the liquid dispensing device 10 is installed on a toilet rim.

Figure 9:
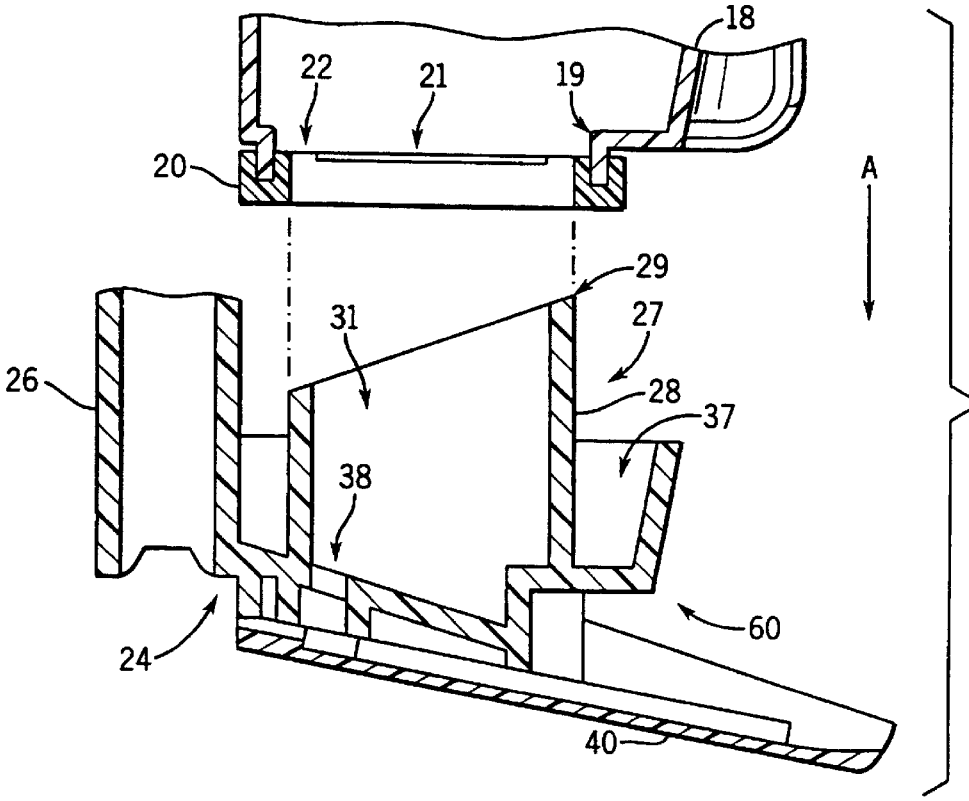
FIG. 9 is a partial sectional view of a bottle and a base of a liquid dispensing device just before installation of the bottle on the base.

Referring to FIG. 9, the installation of the bottle 18 on the base 24 is shown in detail. The piercing post 27 of the base 24 comprises a cylindrical tubular section 28 that forms a feed conduit 31. An upper end 29 of the tubular section 28 terminates obliquely to form an elliptical mouth.

The bottle 18 includes a circular mouth 19 that is covered by a closure 20 that seals the liquid contents in the bottle 18 for shipment and storage. In the version of the bottle shown in the FIG. 9, the closure 20 is a thermoplastic cap with a channel that engages a circular flange at the mouth 19 of the bottle 18. Other closures, such as foil or plastic film, would also be suitable for sealing the mouth 19 of the bottle 18. The central portion of the closure 20 shown in FIG. 9 has a frangible seal 21 with a circular area 22 of reduced thickness. During installation, the bottle 18 is oriented over the piercing post 27 of the base 24 such that the circular inner wall of the closure 20 approximately lines up with the circular outer surface of the piercing post 27, and the bottle is moved in direction A until the upper end 29 of the piercing post 27 causes the circular area 22 of the frangible seal 21 to fracture. The feed conduit 31 of the base is then placed in fluid communication with the mouth 19 of the bottle 18 and liquid may flow from the bottle 18 through the feed conduit 31 and out of dispensing hole 38 at the bottom of the piercing post 27 by way of gravity. By properly dimensioning the piercing post 27 and the closure 20 and the mouth 19 of the bottle 18, a fluid tight seal is formed when the bottle is installed on the base 24.

At the bottom of the base 24, there is a liquid dispensing plate 40 that assists in distribution of the liquid formula into the flush water. The dispensing plate 40 may be a separate component that is attached to the base or may be formed integral with the base 24. The dispensing plate 40 is preferably formed from a non-porous thermoplastic material such as pigmented polyethylene or polypropylene.

Figure 10A:
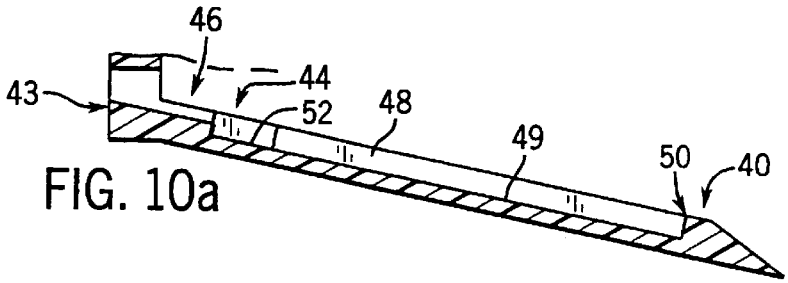
FIG. 10A is a cross-sectional view of a first version of a dispensing plate of a liquid dispensing device.
Figure 10B:
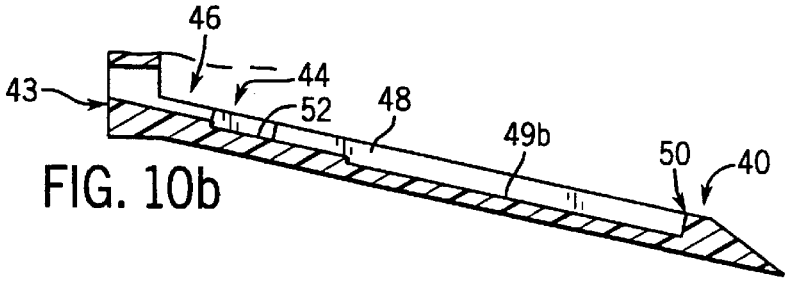
FIG. 10B is a cross-sectional view of a second version of a dispensing plate.
Figure 10C:
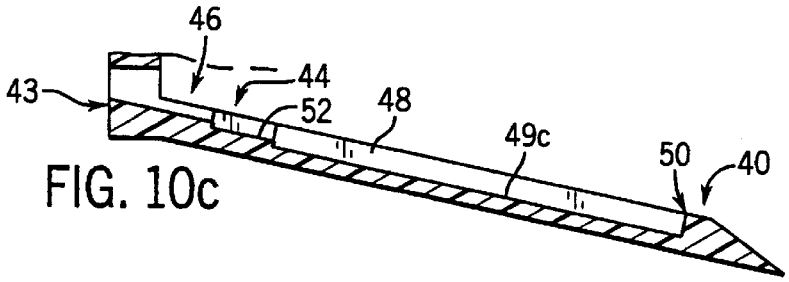
FIG. 10C is a cross-sectional view of a third version of a dispensing plate.
Figure 11A:
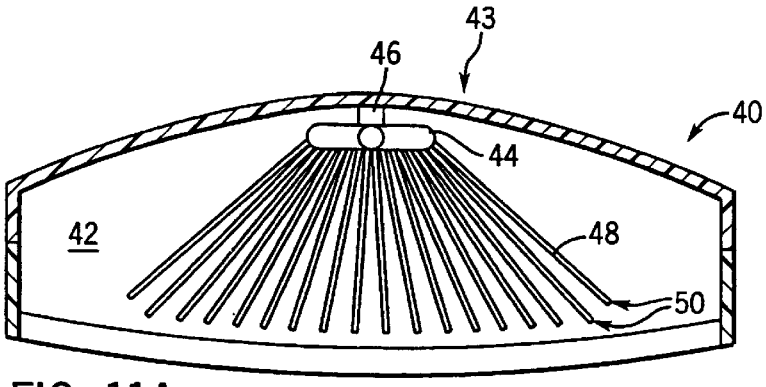
FIG. 11A is a top view of a dispensing plate taken along line 11A—11A of FIG. 8.

FIGS. 8, 10A, 10B, 10C and 11A show the configuration of a first version of the dispensing plate 40 and its positioning on the base 24. Referring first to FIG. 11A, it can be seen the dispensing plate 40 has an upper surface 42 with a series of capillary channels 48 that radiate out from a collecting cavity 44 that is formed in the upper surface 42 at a position inwardly spaced from an edge 43 of the base 24. The capillary channels 48 may have a variety of transverse cross-sectional shapes, and preferably, the capillary channels 48 have a square, rectangular or triangular transverse cross-sectional shape.

Looking at FIGS. 10A, 10B, 10C, it can be seen that the depth of the capillary channels 48 may also be configured in a variety of fashions. In FIG. 10A, the lower surface 49 of the capillary channel 48 is coplanar with the lower surface 52 of the collecting cavity 44 from the collecting cavity 44 to an outer end 50 of the capillary channel 48 such that the depth of the capillary channel 48 is substantially equal to the depth of the collecting cavity 44. In FIG. 10B, the lower surface 49*b* of the capillary channel 48 descends in a step-wise fashion from the lower surface 52 of the collecting cavity 44 to the outer end 50 of the capillary channel 48. In FIG. 10C, the lower surface 49*c* of the capillary channel 48 is positioned below the lower surface 52 of the collecting cavity 44 from the collecting cavity 44 to the outer end 50 of the capillary channel 48 such that the depth of the capillary channel 48 is greater than the depth of the collecting cavity 44.

Other depth configurations of the capillary channels 48 are also possible. For instance, the lower surface 49 of the capillary channel 48 may be inclined downwardly in the direction of the its outer end 50 with respect to the lower surface 52 of the collecting cavity 44. Each of these depth-wise constructions of the capillary channels can serve to control the distribution of liquid to the toilet as will be herein after described.

Figure 11B:
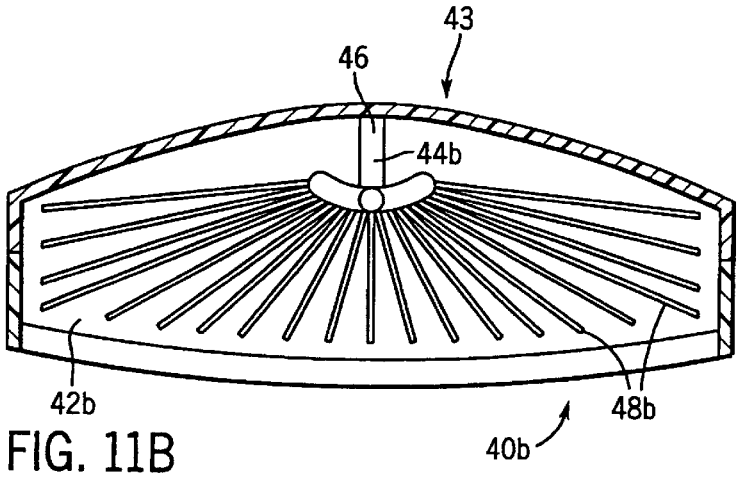
FIG. 11B is a top view of another dispensing plate.
Figure 11C:
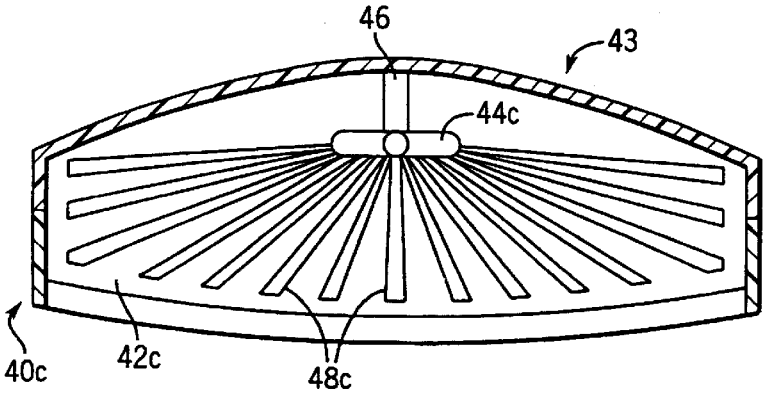
FIG. 11C is a top view of yet another dispensing plate.

Looking at FIGS. 11A, 11B, 11C, 11D and 11E, it can be seen that various layouts of the capillary channels 48 and the collecting cavity in the upper surface 42 of the dispensing plate 40 are also possible. In FIG. 11A, the collecting cavity 44 has an oblong shape that is oriented substantially parallel to the direction of the major axis of the dispensing plate 40 and the capillary channels 48 radiate outward from a side of the oblong collecting cavity 44. In FIG. 11B, a collecting cavity 44*b* has a crescent shape having its major axis oriented substantially parallel to the direction of the major axis of a dispensing plate 40*b* and capillary channels 48*b* radiate outward from a side of the crescent collecting cavity 44*b*. In FIG. 11C, a collecting cavity 44*c* has an oblong shape having its major axis oriented substantially parallel to the direction of the major axis of a dispensing plate 40*c* and capillary channels 48*c* radiate outward from a side of the oblong collecting cavity 44*c* and increase in width as they move away from the oblong collecting cavity 44*c*.

Figure 11D:
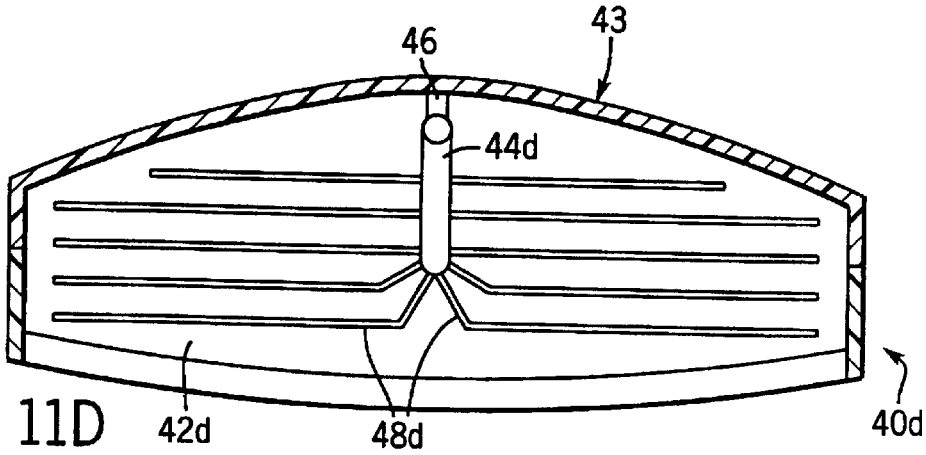
FIG. 11D is a top view of still another version of a dispensing plate.
Figure 11E:
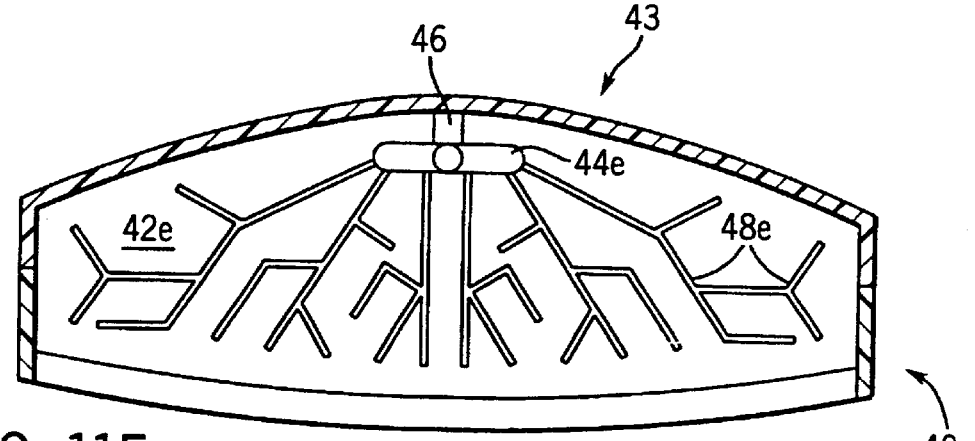
FIG. 11E is another variant of a dispensing plate.

In FIG. 11D, a collecting cavity 44*d* has an oblong shape having its major axis oriented substantially normal to the direction of the major axis of a dispensing plate 40*d* and capillary channels 48*d* radiate outward from both sides of the oblong collecting cavity 44*d* such that a major portion of at least some of the capillary channels 48*d* is substantially parallel to the direction of the major axis of a dispensing plate 40*d*. In FIG. 11E, a collecting cavity 44*e* has an oblong shape having its major axis oriented substantially parallel to the direction of the major axis of a dispensing plate 40*e* and capillary channels 48*e* radiate outward from a side of the oblong collecting cavity 44*e* in a random fashion.

Figure 8:
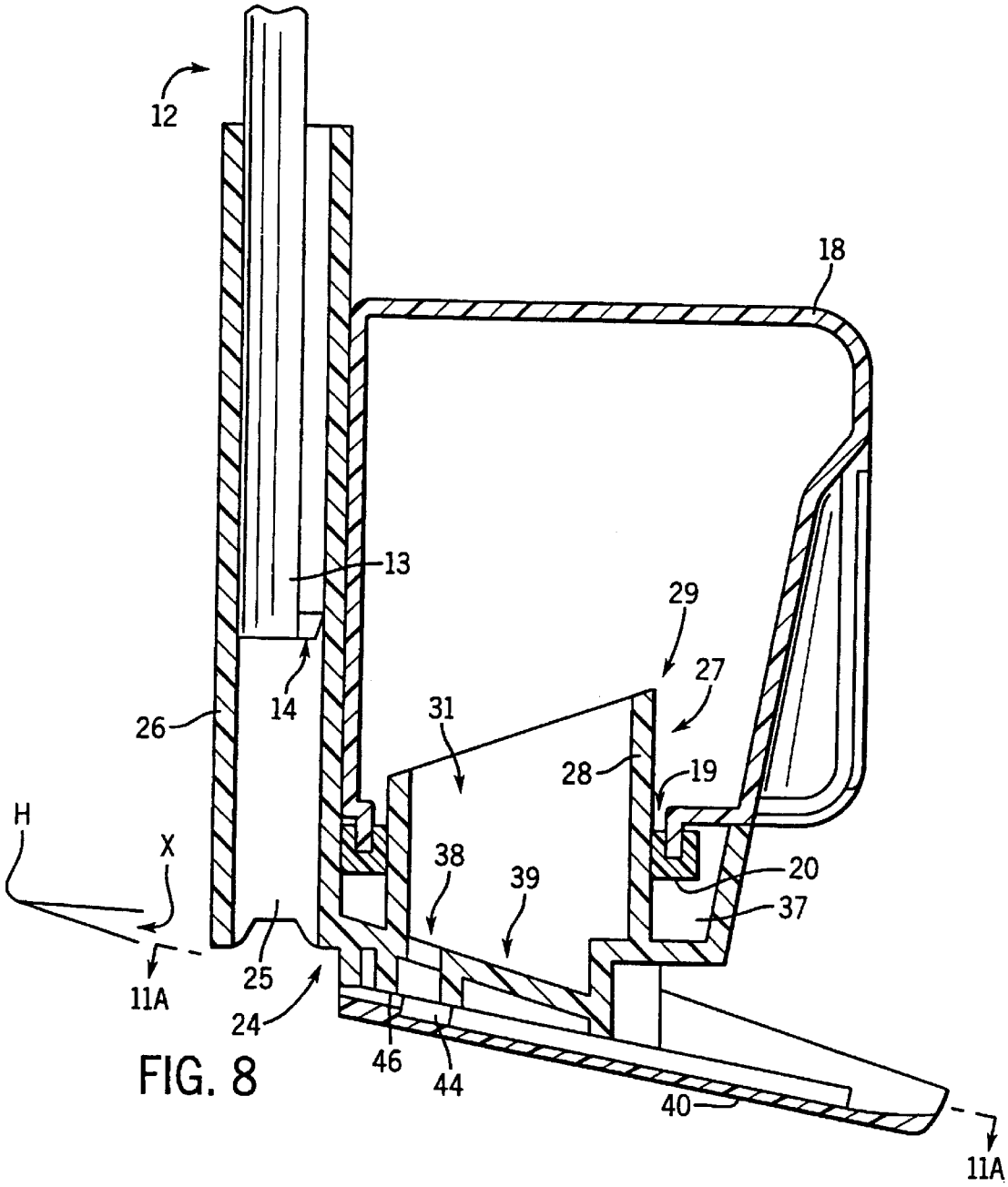
FIG. 8 is a cross-sectional view taken along line 8—8 of FIG. 2.

Turning now to FIG. 8, the positioning of the dispensing plate 40 with respect to the other structures of the base 24 is best shown. The dispensing plate 40 is attached to the base (whether in a separate step or as part of the molding of the base) such that the collecting cavity 44 of the dispensing plate 40 is placed in fluid communication with the feed conduit 31 of the base 24. In the version of the invention shown in FIG. 8, the dispensing hole 38 at the bottom of the piercing post 27 is used to provide a fluid path between feed conduit 31 and the collecting cavity 44 of the dispensing plate 40. As a result of this configuration, liquid flows out of the bottle 18, into the feed conduit 31 of the base 24, through the dispensing hole 38 and into the collecting cavity 44 of the dispensing plate 40. Liquid then flows from the collecting cavity 44 of the dispensing plate 40 into the capillary channels 48 in the upper surface 42 of the dispensing plate 40. The liquid then continues to move toward the outer end 50 of the capillary channels 48 where the liquid is dispensed to the toilet as will be hereinafter described. Various means can be used to move the liquid from the collecting cavity 44 of the dispensing plate 40 into the capillary channels 48. First, the capillary action provided by adherence of the fluid to the sides of the capillary channels 48 serves to move the liquid toward the outer end 50 of the capillary channels 48. Second, the capillary channels 48 may have a depth greater than the depth of the collecting cavity 44, such as is shown in FIGS. 10B and 10C and described above, that serves to move the liquid from the collecting cavity 44 and toward the outer end 50 of the capillary channels 48.

Third, the dispensing plate 40 may be inclined downwardly such that the collecting cavity 44 is higher than the capillary channels 48. For instance, it can be seen in FIG. 8 that the dispensing plate 40 is angled downward at an angle X with respect to horizontal line H. In this arrangement of the dispensing plate 40, the collecting cavity 44 is higher than the capillary channels 48 and liquid flows downward from the collecting cavity 44 to the capillary channels 48. It has been discovered that by arranging the dispensing plate 40 and the base 24 such that angle X is between about 10 degrees and about 30 degrees, enhanced liquid flow properties can be attained. The downward angle of the dispensing plate 40 also serves to minimize water uptake into the bottle 18 during operation. Of course, each of these methods of controlling liquid flow from the collecting cavity 44 into the capillary channels 48 can be used alone or in conjunction with the other available methods.

During investigation of the optimal configuration of the dispenser, the actual mechanism of operation was closely studied. While we do not wish to be bound by theory, it is believed that the dispenser operates on a principle of air-liquid exchange mechanism. When the device is first activated, the active liquid present in the reservoir flows out into the capillaries mainly under the combined influence of gravitational and capillary forces. As this occurs, vacuum develops in the head space above the liquid in the reservoir. This vacuum opposes the gravitational and capillary forces pulling the liquid out of the reservoir, thus resulting in a decrease in the release rate, until release is completely inhibited when the vacuum reaches a sufficient magnitude. From this point onward, release of liquid from the reservoir may occur only if some air enters the head space to decrease the level of vacuum. If water enters the reservoir, it only leads to dilution of the active product, but not a decrease in its level. But, during flushing, a mixture of air and water enters into the reservoir, leading to some dilution as well as a decrease in the level of the product. The relative proportion of air and water entering into the reservoir during flushing determines the extent of dilution of the product, as well as the decrease in the level thereof. Ideally, only air would be admitted to the reservoir during flushing. In addition to the flows arising from the forces discussed above, other factors enter into the flow of liquid from the reservoir, such as surface tension gradients on the surface of the liquid in the capillaries, and diffusion of the surfactants, dyes and other components present in the liquid. Such latter factors do not generally lead to a decrease in the level of liquid in the reservoir. Accordingly, the influx of air into the reservoir head space is a necessary condition.

Several parameters were investigated, such as the angle at which the dispensing plate 40 is angled with respect to the horizontal, the viscosity of the liquid dispensed, the intensity of the flushing action, and the role of the capillaries on the capillary plate. These parameters were investigated using an apparatus whereby the weight loss of the liquid in the dispenser could be measured as a function of the number of flushes (i.e. the release rate), the angle of the dispensing plate to the horizontal could be varied between 0 and 30 degrees, the viscosity of the liquid dispensed could be varied between 2000 and 4000 centipoise, using either 50 or 250 ml of water per flush, and dispensing plates either with or without the capillaries could be employed.

Relative to intensity of flushing, it is to be noted that the flushing intensity changes from location to location under the rim of a real-life toilet bowl. As anticipated, it was found that the release rate of liquid in the reservoir increases with flushing intensity. That is, the release rate when flushing with 250 ml of water is higher than the rate when flushing with 50 ml. Increasing the intensity of flushing usually increases the degree of turbulence in the region between the capillary plate and the exit hole of the reservoir. This increased turbulence should lead to an increased proportion of air to water entering into the reservoir during flushing. The net effect of this, as previously indicated, is an increase in the release rate. Flushing action, in addition to creating turbulence, also causes mechanical vibration of the dispenser, which vibration creates instability in the air/liquid meniscus or interface at the exit hole of the reservoir. The greater the instability, the easier it is for the air bubble to enter the head space. However, the magnitude of the difference of release rate depends upon other factors, such as the angle of the dispensing plate, and the viscosity of the fluid.

In studying the angle between the capillary plate and the horizontal, the angle between the capillary plate and the axis of the reservoir was kept unchanged, so as to isolate the causative factor of any changes observed. The effect of the angle of the capillary plate on the release rate is quite pronounced. At a 0 degree angle between the plate and the horizontal, at flush rates of both 50 and 250 ml of water, very little liquid was removed from the reservoir after 112 flushes. That is, about 95 percent of the liquid remained in the reservoir after the completion of 112 flushes at either 50 or 250 ml per flush, at a 0 degree angle. However, when the angle was changed to 30 degrees, only about 20 percent of the liquid remained in the reservoir after 112 flushes at 50 ml of water per flush, and at 250 ml per flush, only 20 percent of the liquid remained in the reservoir after only 80 flushes. Accordingly, it has been found that the angle between the dispensing plate and the horizontal should be greater than about 5 degrees, preferably between about 10 and about 30 degrees, and more preferably between about 20 and about 30 degrees. The reason for this difference in response to change of angle between the dispensing plate and the horizontal is that with increasing angle, the meniscus of the pendant drop which forms at the exit hole of the reservoir departs from axisymmetry. With increasing departure, a situation arises in which the meniscus becomes, with respect to liquid in the reservoir, concave downwards on one side of the exit hole, and convex upwards on the other side. This makes it easier for an air bubble to enter into the head space due to the vibrations and turbulence created during flushing. In fact, if the angle exceeds a critical value, the liquid may come out continuously while air is admitted continuously on the other side of the exit hole. The value of this critical angle is dependent upon such factors as the size of the exit hole, the surface tension of the liquid, and the contact angle between the liquid and the solid surface of the reservoir.

The rheology of the liquid in the reservoir also has an influence upon a number of parameters which affect the performance of the device. The viscosity of the liquid offers the major resistance to the release of the liquid for a given positive overall driving force. Both viscosity and elastic properties of the liquid have an impact on the rate of growth of instability at the air/liquid meniscus which forms either due to the flushing action or due to the development of a sufficient vacuum within the head space of the reservoir for a given plate angle. Thus, the viscosity and the elastic properties determine whether an air bubble can even move up into the head space, and if it can, they determine the rate at which the bubble moves. If the liquid has a high yield strength, the air bubble may not be able to move upward into the head space. While elastic properties, e.g. yield strength, of the liquid product used in the dispenser were not measured, viscosities were varied between 2000 and 4000 centipoise to determine the release rates from the device at two different plate angles (15 and 30 degrees.) One hundred flushes were used for each of four combinations of reservoir liquid viscosity and angle. At the completion of the one hundred flushes, the percentage of liquid remaining in the reservoir was determined for each of the tests. It was found that about 94.5 percent remained of a 3500 centipoise liquid dispensed at 10 degrees, about 91 percent remained of a 2000 centipoise liquid dispensed at 10 degrees, about 82.5 percent remained of a 3500 centipoise liquid dispensed at 20 degrees, and about 80.5 percent remained of a 2000 centipoise liquid dispensed at 20 degrees. Accordingly, it may be seen that the viscosity of the liquid has a definite effect upon rate of dispensing, with lower viscosity liquid being more rapidly dispensed, and that higher angles between the dispensing plate and the horizontal also result in more rapid dispensing. While viscosities of up to about 10,000 are acceptable for the liquid to be dispensed, it is preferred that the viscosity of the liquid be greater than about 1000, preferably greater than about 2000, and most preferably between about 2000 and about 4000.

The role of the capillaries in the dispensing plate on the release rate was also considered. Using plates both with and without capillaries, experiments were performed to determine the release rates from the device at two different plate angles, (15 and 30 degrees), and two different viscosities (2000 and 4000 centipoise). It was found that the capillaries have a positive influence on release rate, particularly at low viscosities and high plate angles.

Figure 12:
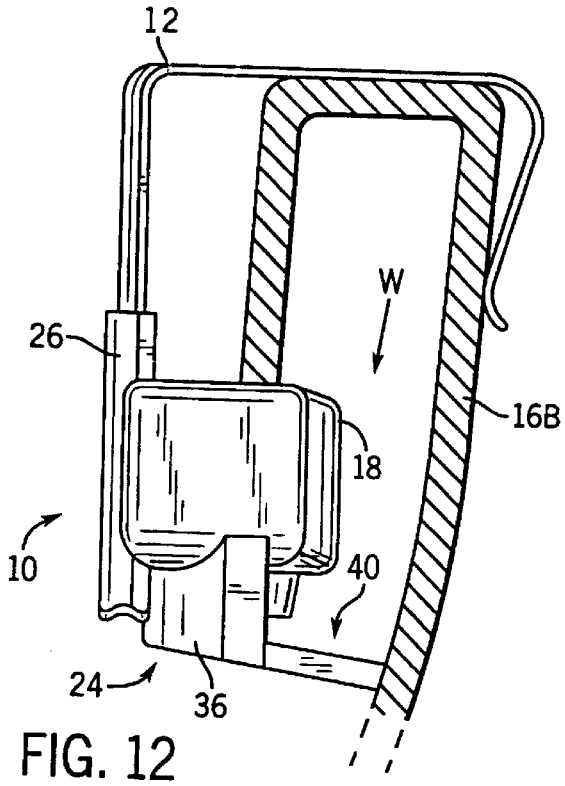
FIG. 12 is a schematic sectional view of a liquid dispensing device in accordance with the invention installed on an open rim type toilet bowl.
Figure 13:
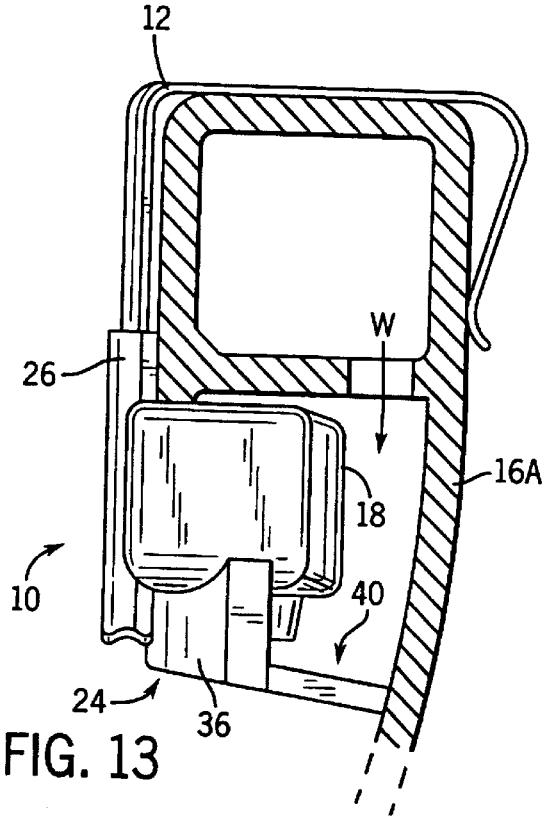
FIG. 13 is a schematic sectional view of a liquid dispensing device in accordance with the invention installed on a boxed rim type toilet bowl.

Having described the means for moving liquid from the bottle 18 to a position on the upper surface 42 of the dispensing plate 40, the use of the liquid dispensing device 10 can be described by reference to FIGS. 12 and 13. FIG. 12 illustrates the configuration of the liquid dispensing device 10 when used with a toilet 16B with an open rim. With the liquid dispensing device 10 suspended from the rim of toilet 16B, it can be seen that the stream of flushing water W will contact the dispensing plate 40 with each flush. FIG. 13 illustrates the configuration of the liquid dispensing device 10 when used with a toilet 16A with a box rim. With the liquid dispensing device 10 suspended from the rim of toilet 16A, it can be seen that the stream of flushing water W will also contact the dispensing plate 40 with each flush. When the flushing water contacts the dispensing plate 40 in FIGS. 12 and 13, the flush water mixes with the liquid present in the capillary channels 48 on the upper surface 42 of the dispensing plate 40 and then is distributed into the toilet.

After the flushing water washes liquid from a dispensing portion of the dispensing plate 40 into the toilet water, a fresh supply of liquid is distributed from the bottle 18 to the capillary channels 48 as described above. In order to allow air to vent up into the bottle 18 when liquid is dispensed into the flushing water, there is provided a venting slot 46 (shown best in FIGS. 8, 10A and 11A) in the upper surface 42 of the dispensing plate 40. The venting slot 46 provides a fluid path between the collecting cavity 44 and the edge 43 of the base 24. The fluid path permits ambient air to enter the bottle 18 to displace liquid dispensed therefrom.

Looking now at FIG. 14, there is shown an optional feature of the liquid dispenser 10 that serves to control the distribution of the liquid formula into the toilet water. Specifically, a deflector 55 is attached to the edge of the dispensing plate 40 to further control the distribution of the liquid formula into the toilet water. The deflector 55 allows the liquid dispenser 10 to accommodate the wide variety of toilet bowl contours in the numerous toilets on the market. In one version of the deflector 55, the deflector 55 is formed from a flexible material and acts as flexible membrane, conforming to the shape of the inner surface of the toilet bowl allowing toilet flush water from the toilet to be channeled over the dispensing plate 40, further insuring that the liquid formula is washed into the toilet at every flush. This version of the deflector 55 may be formed by a multi-injection molding technique wherein two different thermoplastic materials, a soft wiper material for the flexible deflector and a harder material for the dispensing plate are molded together. In another version of the deflector, the deflector is hinged to the edge of the dispensing plate so that the deflector can conform to the shape of the inner surface of the toilet bowl. In still another version of the deflector, the deflector and the dispensing plate are configured such that the dispensing plate includes guide slots that engage the deflector and allow the deflector to slide toward and away from the edge of the dispensing plate so that the deflector can conform to the shape of the inner surface of the toilet bowl.

Figure 15:
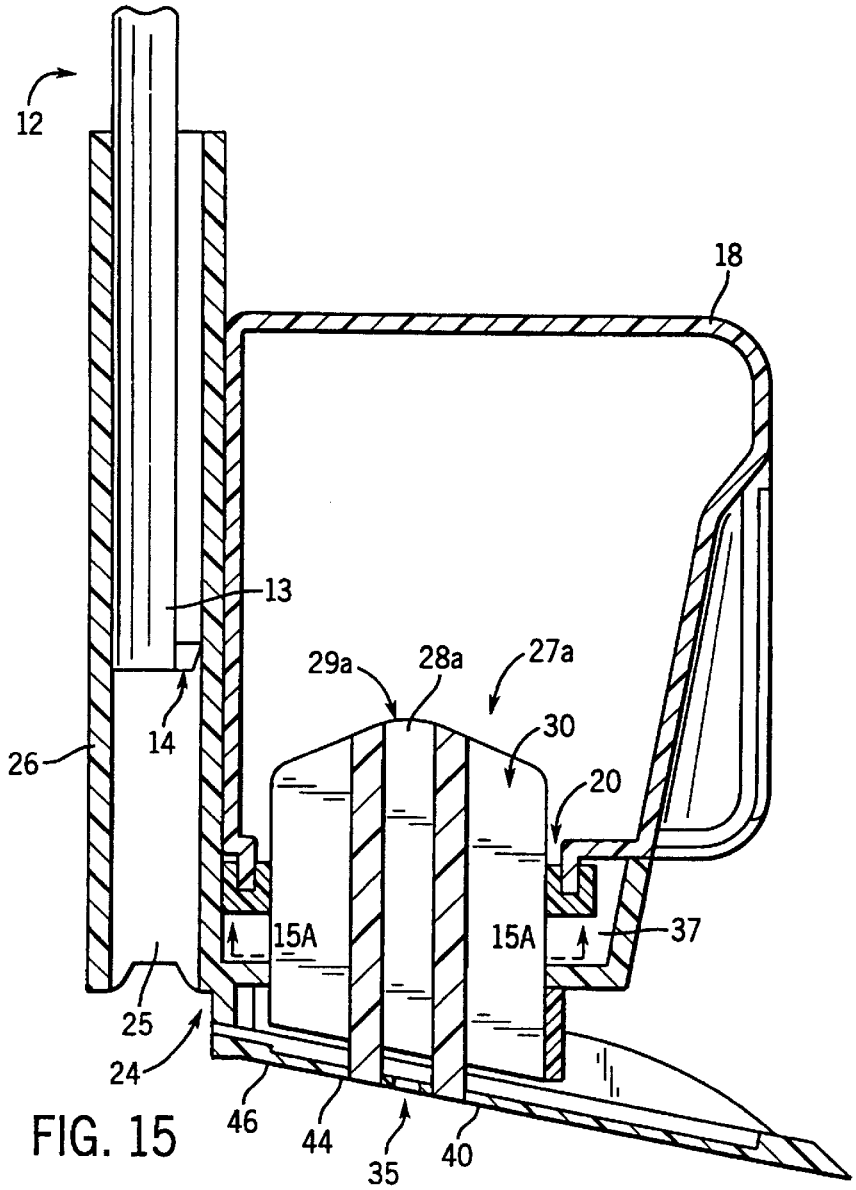
FIG. 15 is an enlarged cross-sectional view of a liquid dispensing device in accordance with the invention showing another version.
Figure 15A:
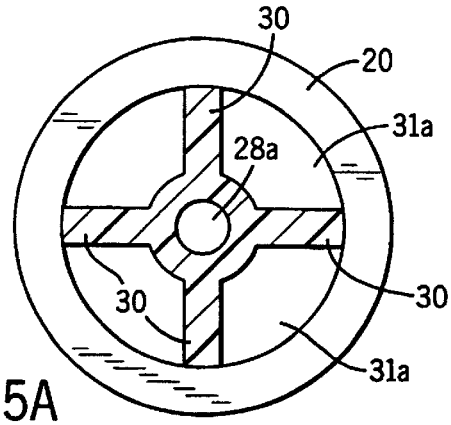
FIG. 15A is a cross-sectional view taken along line 15A—15A.
Figure 17:
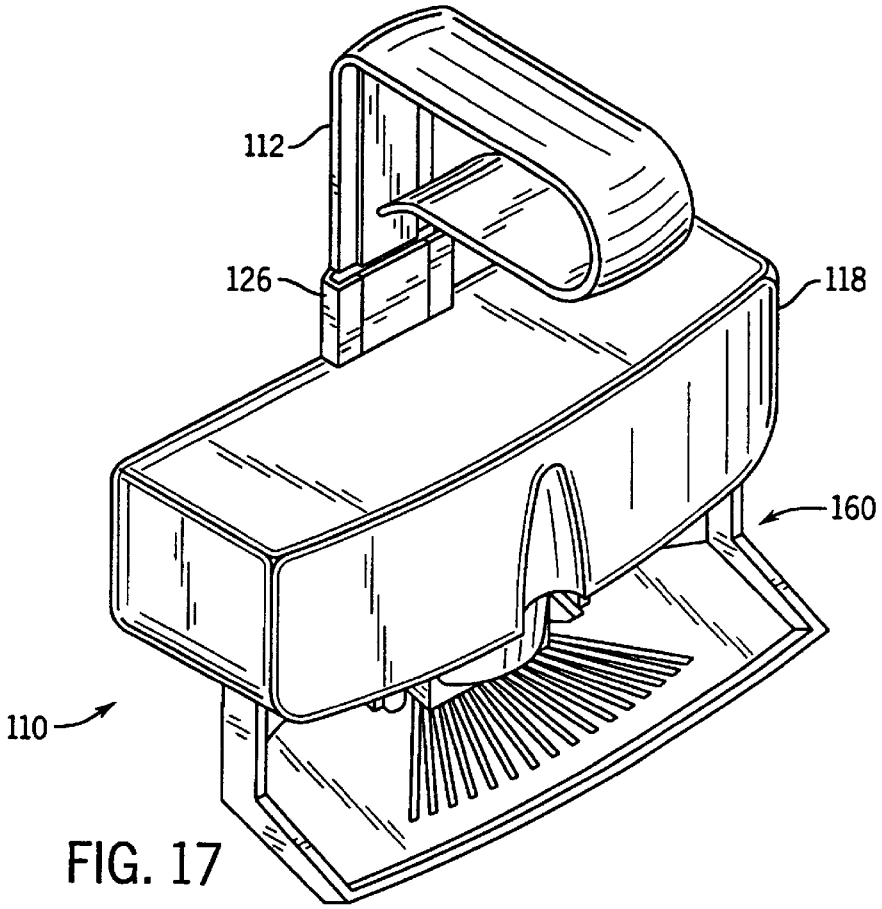
FIG. 17 is a perspective view of a liquid dispensing device in accordance with the invention, showing yet another version.
Figure 19:
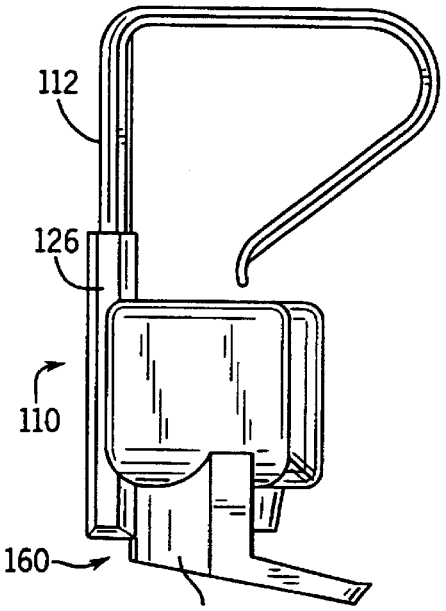
FIG. 19 is a right side elevational view of the liquid dispensing device of FIG. 17, the left side being the mirror image thereof.
Figure 18:
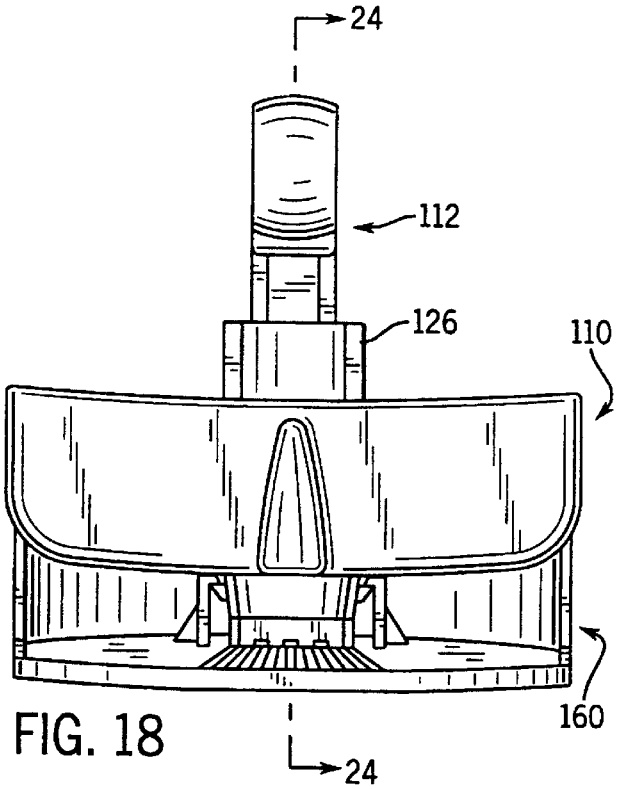
FIG. 18 is a front, elevational view of the liquid dispensing device of FIG. 17.

An alternative configuration of the piercing post of the liquid dispenser is shown in FIGS. 15 and 15A. In this embodiment, a piercing post 27*a* has a central venting conduit 28*a* and fins 30 that extend outwardly from the central venting conduit 28*a*. The central venting conduit 26*a* and the fins 30 define feed conduits 31*a*. An upper end 29*a* of the central venting conduit 28*a* of the piercing post 27*a* is used to open the closure 20 of the bottle by causing the circular area 22 of the frangible seal 21 to fracture. The feed conduits 31*a* are then placed in fluid communication with the mouth 19 of the bottle 18 and liquid may flow from the bottle 18 through the feed conduits 31*a* and onto the upper surface 42 of the dispensing plate 40. In this embodiment of the piercing post 27*a*, air is vented up into the bottle 18 through a hole 35 in the dispensing plate and through the central venting conduit 26*a* when liquid is dispensed into the flushing water.

Referring to FIG. 16, there is shown another version of a liquid dispenser 10A for dispensing a liquid from the rim of a toilet bowl. In this version of the invention, a modified base 24*a* is used for holding the bottle 18. The base 24*a* has essentially the same features as the base 24 shown in FIGS. 1–9 and described above. However, a dispensing hole 38*a* is provided at a central portion at the bottom of the piercing post 27 of base 24*a* and the base 24*a* includes a lower plate 34 that extends outwardly from a wall of the piercing post 27. The lower surface of the lower plate 34 also includes a flow groove 39 that serves to channel liquid from the dispensing hole 38*a* toward the edge of the lower plate 34. The liquid dispenser 10A also includes a dispensing plate 40*a* that is integral with or attached to the base 24*a* in spaced apart relationship with the lower plate 34 of the base 24*a*. In this configuration, an upper surface 42*g* of the dispensing plate 40*a* receives liquid from the feed conduit 31 through the dispensing hole 38*a*. The liquid dispenser 10A is configured such that the spacing between the upper surface 42*g* of the dispensing plate 40*a* and the lower plate 34 of the base 24*a* varies along the length of the dispensing plate 40*a*. It can be seen in FIG. 16 that distance D1 is greater than distance D2 between the dispensing plate 40*a* and the lower plate 34 of the base 24*a*.

When the liquid dispenser 10A of FIG. 16 is installed on a toilet rim, the edge of the dispensing plate 40*a* nearest the inner surface of the toilet bowl and the edge of lower plate 34 nearest the inner surface of the toilet bowl are closest together. This is depicted as dimension D3 in FIG. 16. As the dispensing plate 40*a* and the lower plate 34 move away from the inner surface of the toilet bowl, the spacing between the dispensing plate 40*a* and the lower plate 34 increases. At the edge of the dispensing plate 40*a* furthest from the inner surface of the toilet bowl and the edge of lower plate 34 furthest from the inner surface of the toilet bowl, a venting space 58 is created between the dispensing plate 40*a* and the lower plate 34 to allow air to vent up into the bottle 18 through the feed conduit 31 when liquid is dispensed into the flushing water.

It has been determined that the dispensing plate 40*a* and the lower plate 34 should be tilted downward in order for liquid formula to accumulate on the dispensing plate 40*a* and the lower plate 34 where they are closest together. Therefore, the lower plate 34 is inclined with respect to an inner surface of the toilet bowl when the liquid dispenser is installed on the rim of the toilet bowl. This is shown in FIG. 16 wherein the lower plate 34 is angled downward at an angle Y with respect to horizontal line H. Also, the dispensing plate 40*a* is inclined with respect to an inner surface of the toilet bowl when the liquid dispenser is installed on the rim of the toilet bowl. It has been discovered that by arranging the dispensing plate 40*a* and lower plate 34 such that angle Y is between about 10 degrees and about 30 degrees, enhanced liquid flow properties can be attained. In addition, water uptake is minimized with the inclined relationship of the dispensing plate 40*a* and the lower plate 34 relative to the inner surface of the toilet bowl. A flexible deflector 55*a* may also be attached to the edge of the dispensing plate 40*a* to further control the distribution of the liquid formula into the toilet water as described above.

The spacing between the dispensing plate 40*a* and the lower plate 34 is varied depending on the type of liquid used in the bottle 18. Specifically, it has been discovered that the viscosity of the liquid and the surface tension of the liquid are the critical factors in determining the precise spacing desired between the dispensing plate 40*a* and the lower plate 34 at various points along the length of the dispensing plate 40*a* and the lower plate 34. By arranging the spacing between the dispensing plate 40*a* and the lower plate 34 in dependence on the values of the viscosity and the surface tension of the liquid, the flow of liquid to the edge of the dispensing plate 40*a* can be controlled and therefore, the amount of liquid dispensed in each flush can be controlled.

Figure 22:
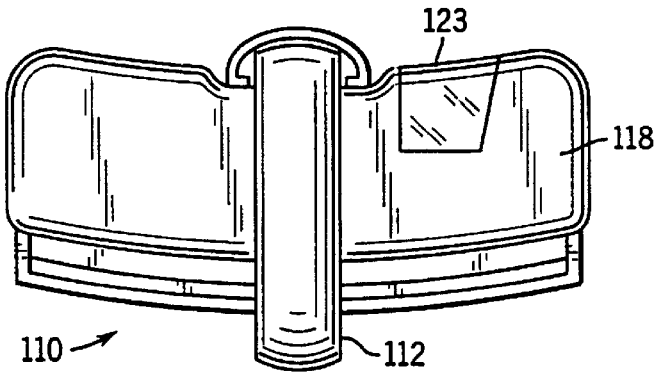
FIG. 22 is a top view of the liquid dispensing device of FIG. 17.
Figure 23:
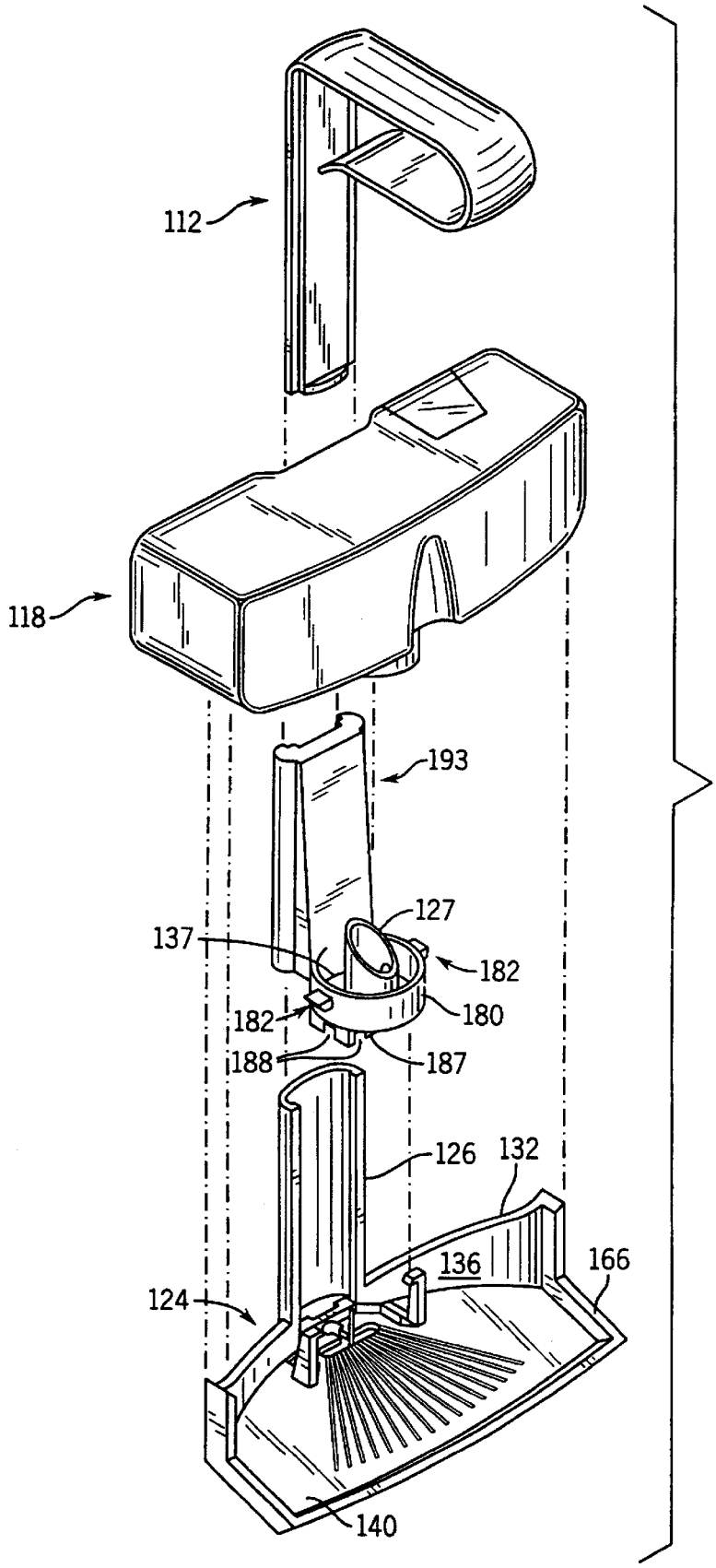
FIG. 23 is an exploded view showing the components of the liquid dispensing device of FIG. 17.

Referring now to FIGS. 17–28, there is shown yet another liquid dispenser 110 for dispensing a liquid from the rim of a toilet bowl. The liquid dispenser 110 includes a bottle 118 for holding a liquid, a base 124, an insert 193 which is attachable to the base 124 to define a mounting structure 160 for holding the bottle 118, and a suspension hook 112 for suspending the mounting structure 160 and the bottle 118 from the rim of a toilet. For ease of manufacture, the suspension hook 112, the bottle 118, the insert 193, and the base 124 may be formed as separate components, as shown in FIG. 23. While a variety of materials may be used to form the suspension hook 112, the bottle 118, the insert 193, and the base 124, it is preferable to manufacture these components from an opaque thermoplastic material such as a pigmented polyethylene or polypropylene. The liquid used in the dispenser may be any liquid formula having the cleaning, foaming, disinfecting and fragrancing characteristics desired for the specific toilet cleaning application.

Figure 21:
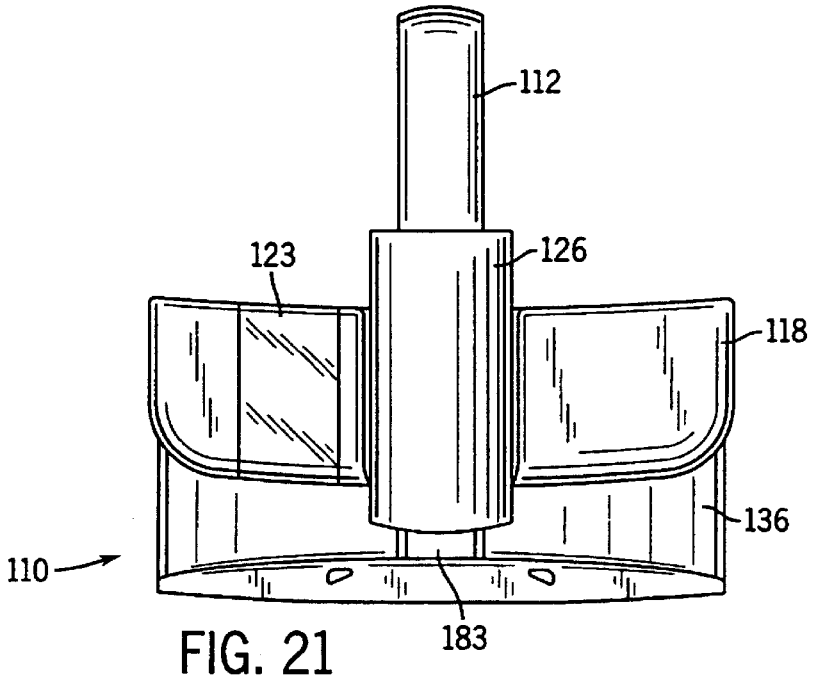
FIG. 21 is a rear view of the liquid dispensing device of FIG. 17.
Figure 20:
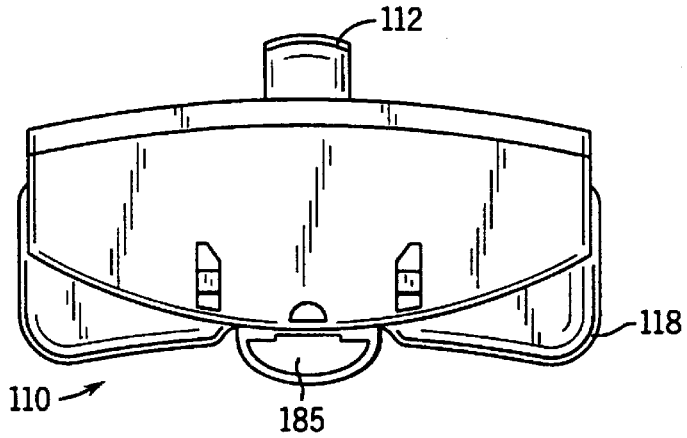
FIG. 20 is a bottom view of the liquid dispensing device of FIG. 17.

In a preferred form of the bottle 118, shown in FIGS. 21 and 22, the bottle includes a clear or transparent view stripe 123 which extends vertically on a portion of the otherwise opaque bottle 118. This clear view stripe permits the user to see the remaining level of liquid in the bottle 118. The specific location and exact dimensions of the clear view stripe in relation to the width of bottle 118 are not critical, so long as the contents of the bottle are readily viewable by the consumer. In one preferred embodiment of the invention, the bottle 118 is loaded with approximately 45 milliliters of liquid formula before the device is hooked on the rim of the toilet for use.

Figure 25:
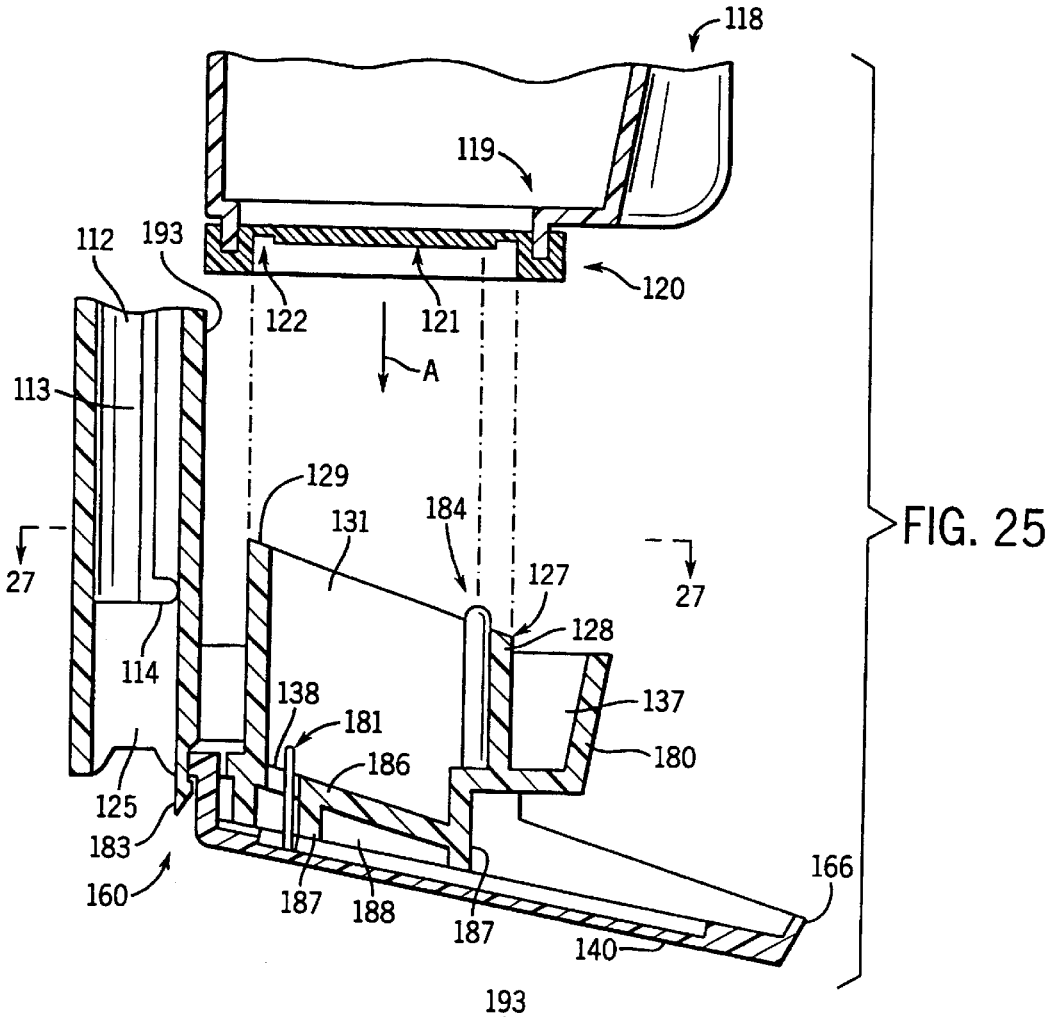
FIG. 25 is a partial sectional view of a bottle and a base of a liquid dispensing device of FIG. 17, just before installation of the bottle on the base.
Figure 26:
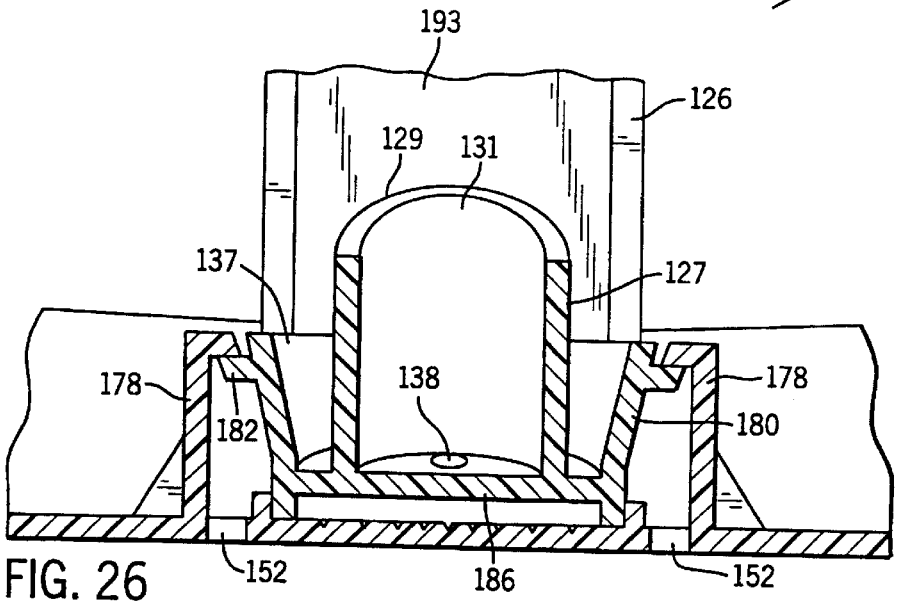
FIG. 26 is a cross-sectional view taken along line 26—26 of FIG. 27.
Figure 27:
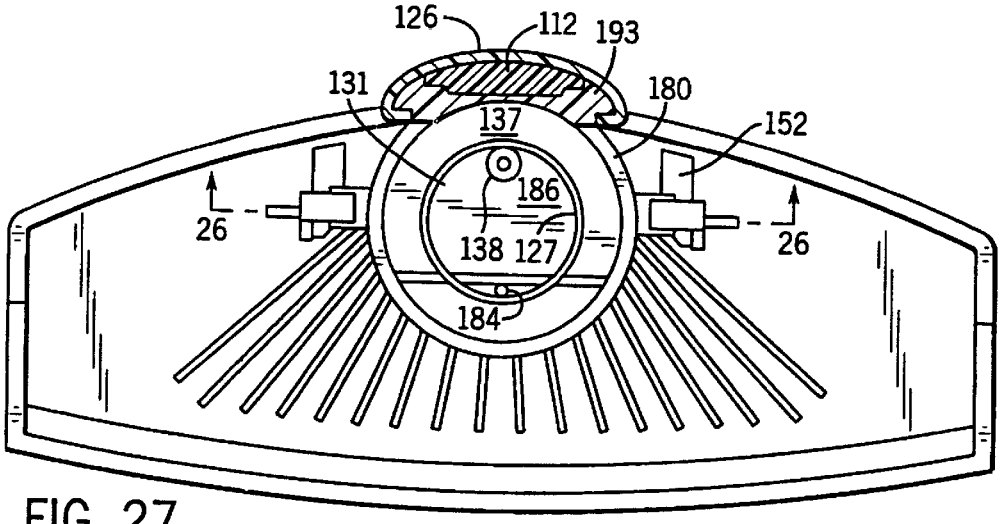
FIG. 27 is a top view of a base of the liquid dispensing device of FIG. 17 taken along line 27—27 of FIG. 25.
Figure 27A:
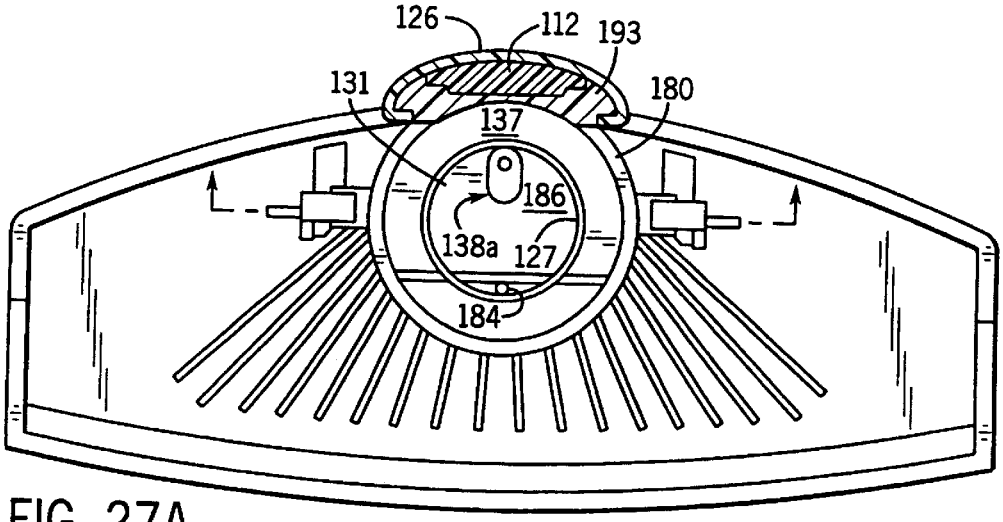
FIG. 27A is a top view of another version of the base of the liquid dispensing device of FIG. 17 taken along line 27—27 of FIG. 25.

The insert 193 and the base 124 are assembled together in order to form the mounting structure 160 for bottle 118. As shown in FIG. 23, a cylindrical wall 180 extends outward from the lower end of the insert 123 to thereby create an annular channel 137 surrounding piercing post 127, the interior of which defines feed channel 131, which is used to conduct fluids form the bottle 118 when the liquid dispensing device 110 is installed on a toilet rim. The cylindrical wall, or annular channel wall 180, which is the outer wall of annular channel 137, engages the outer surface of the mouth of the bottle 118 when said bottle is engaged with piercing post 127, just as the piercing post 127 engages the inner surface of said bottle mouth, thus providing a leak-proof engagement of the piercing post and the mouth of the bottle. The annular channel wall 180 of the insert 193 has outwardly protruding diametrically opposed tabs 182, and flexing engagement means 183, which aids in correctly and solidly positioning the base 124 and locking the bottle in position relative to the base, while aiding in assembly of the components of the dispenser. Further details of the insert 193 may be seen in FIGS. 24–27, where it may be seen that the piercing post 127 defines feed conduit 131 that terminates in a bottom or lower wall 186. As shown in FIGS. 24–27, lower wall 186 forms the bottom of the cylindrical conduit 131, and has a dispensing hole 138 therein, which while preferably circular, may be oblong, as shown in FIG. 27*a* a dispensing hole 138*a*. The lower wall 186 also includes an upwardly extending projection 184, extending above an upper edge 129 of the piercing post 127. Further, lower wall 186 comprises a riser, 187, which serves to separate lower wall 186 of the feed conduit from the upper surface 142 of the dispensing plate 140.

The insert 193 and the base 124 are assembled together as follows. As shown in FIG. 23, the base 124 includes an integral elongated upright member 126 which receives the insert 193. The insert 193 is moved downwardly into the upright member 126 until the outwardly protruding, and preferably diametrically opposed tabs 182 on the cylindrical wall 180 are positioned below, and engaged with, mounting clips 178 extending upwardly from the base 124 (FIG. 26). Simultaneously, tab 183 engages with the base 124, providing an additional degree of support security. At the same time, a guide channel 125, extending the length of the upright member 126 is formed between insert 193 and upright 126, into which channel the suspension hook 112 is inserted when the base 124 and bottle 118 are installed on a toilet rim. A lower end 113 of the suspension hook 112 includes a tab portion 114 which engages the inner surface of the guide channel 125 in a press fit arrangement upon insertion of the suspension hook 112 into guide channel 125, such that the suspension hook 112 remains attached to the base 124, as shown in FIGS. 25 and 25. It may be appreciated that the telescoping arrangement of the guide channel 125 and suspension hook 112 allows the liquid dispenser to fit a wide variety of toilet rim configurations. Viewing FIG. 23, it may be seen that the base 124 also includes a rear wall 136 which terminates at an upper edge 132, creating a section of the mounting structure 160 that supports the bottle 118 when the bottle is installed on the base 124.

Referring to FIG. 25, the installation of the bottle 118 on the mounting structure 160 is shown in detail. The piercing post 127 of the insert 193 comprises a cylindrical tubular section 128, forming the feed conduit 131. The upper edge 129 of the tubular section 128 terminates obliquely to form an elliptical mouth.

The bottle 118 includes a circular mouth 119 that is covered by a closure 120 that seals the liquid contents in the bottle 118 for storage and shipment, and until use. In the version of the bottle shown in FIG. 25, the closure is a thermoplastic cap with a channel that engages a circular flange at the mouth 119 of bottle 118. Other closures, such as foil or plastic film, are also suitable for scaling the mouth of the bottle. The central portion of closure 120, as shown in FIG. 25, has a frangible seal 121 with a circular area 122 of reduced thickness. During installation, the bottle 118 is oriented over the piercing post 127 such that the circular inner wall of the closure 120 approximately lines up with the circular outer surface of the piercing post 127, and the bottle is moved in direction A, toward the base 124, until the upper edge of the piercing post 127 causes the circular area 122 of the frangible seal 121 to fracture. The upwardly extending projection 184, on the lower wall 186 of the insert 193, serves to keep the frangible seal 121 off of the upper edge 129 of the piercing post 127, preventing the frangible seal from resealing the elliptical mouth of feed conduit 131 while liquid flows from mouth 119 of the bottle 118 through the feed conduit 131 and out of the dispensing hole 138 in the bottom or lower wall 186. Simultaneously, the mouth 119 of the bottle 118 is inserted into the annular channel 137 formed between wall 180 and the cylindrical tubular section 128 of piercing post 127. By proper dimensioning of the piercing post 127, the closure 120, and the mouth of bottle 118, a fluid tight seal is formed when the bottle is installed on the base 124.

Looking now at FIGS. 17–28, it can be seen that at the bottom of base 124, there is a liquid dispensing plate 140 that assists in distribution of the liquid formula into the flush water. This dispensing plate may be a separate component attached to the base or may be integral to the base 124 as illustrated. The dispensing plate 140 is preferably formed from a non-porous thermoplastic material, such as pigmented polyethylene or polypropylene.

Figure 28:
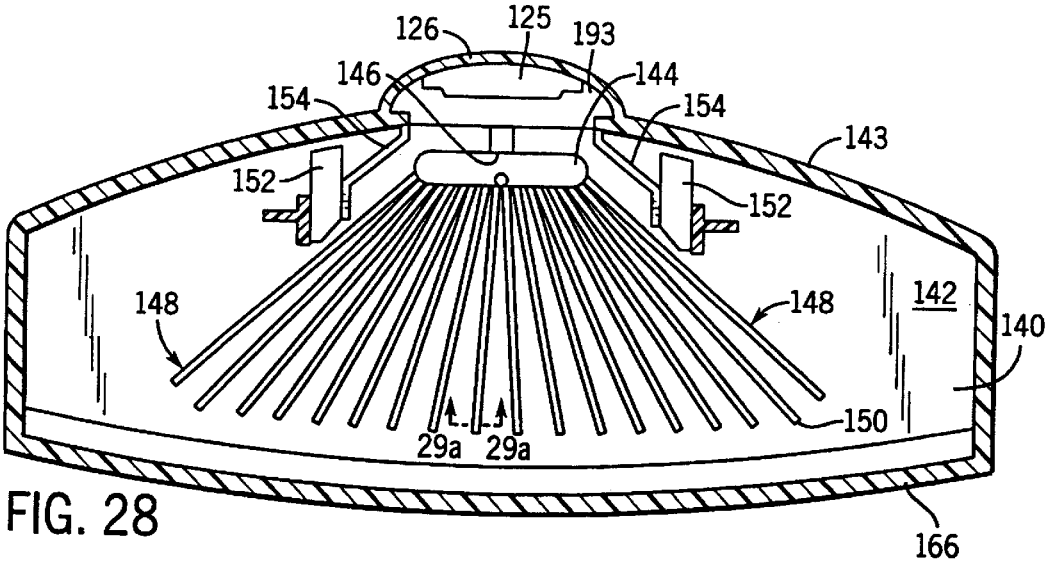
FIG. 28 is a top view of a dispensing plate taken along line 28—28 of FIG. 24.

FIG. 28 illustrates the configuration of the dispensing plate 140. It may be seen that the dispensing plate 140 has a rim 166 at the perimeter of upper surface 142 having a series of capillary channels 148 which radiate out from a collecting cavity 144 that is formed in the upper surface 142 of the dispensing plate at a position inwardly spaced from an edge 143 of the base 124. The capillary channels 148 may have a variety of transverse cross-sectional shapes, as shown in FIGS. 29*a*–29*f*.

Figure 29A:
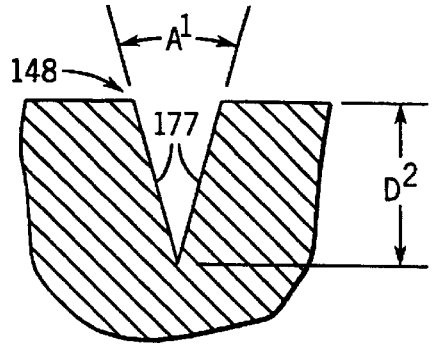
FIG. 29*a* is a cross-sectional view of a capillary channel taken along line 29*a*—29*a* of FIG. 28.
Figure 29B:
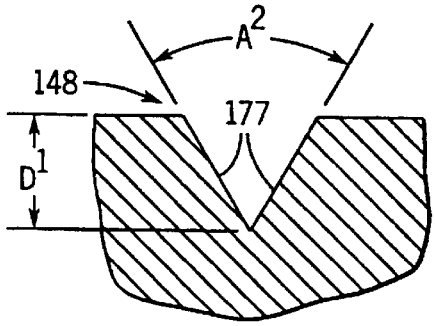
FIG. 29*b* is another cross-sectional view of a capillary channel taken along line 29*a*—29*a* of FIG. 28.
Figure 29C:
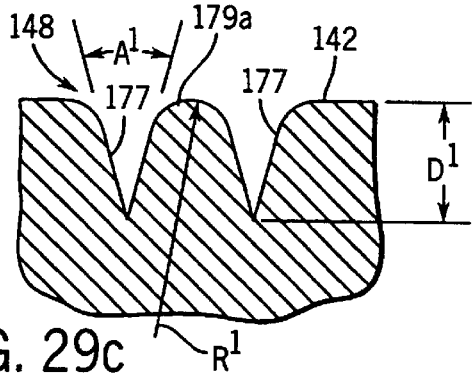
FIG. 29*c* is yet another cross-sectional view of a capillary channel taken along line 29*a*—29*a* of FIG. 28.
Figure 29D:
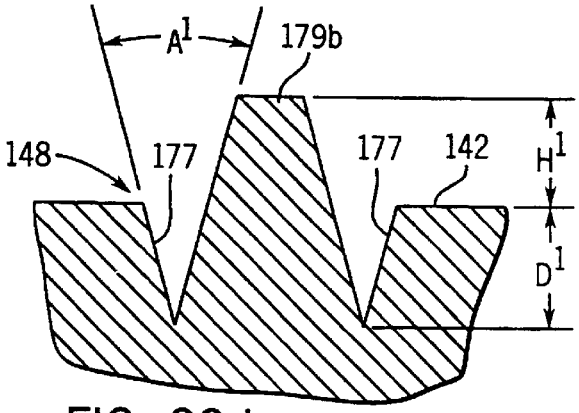
FIG. 29*d* is still another cross-sectional view of a capillary channel taken along line 29*a*—29*a* of FIG. 28.
Figure 29E:
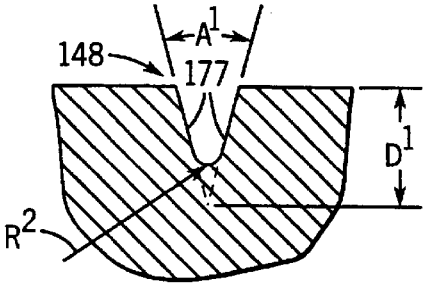
FIG. 29*e* is a further cross-sectional view of a capillary channel taken along line 29*a*—29*a* of FIG. 28.
Figure 29F:
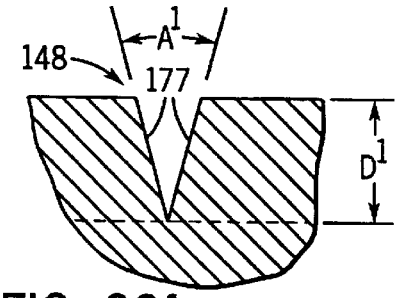
FIG. 29*f* is an additional cross-sectional view of a capillary channel taken along line 29*a*—29*a* of FIG. 28.

Observing FIGS. 29*a*–29*f*, it may be seen that the capillary channels 148 may have inclined side walls 177 that form various included angles between the side walls, such as angle $A^1$ in FIGS. 29*a* and 29*c*–29*f*, and angle $A^2$ in FIG. 29*b*. The capillary channels may also have various depths, such as $D^1$ in FIGS. 29*b*–29*f*, and $D^2$ in FIG. 29*a*. The center of each such capillary channel may also include an upwardly extending projection such as projection 179*a* in FIG. 29*c*, which extends up to the upper surface 142 of the dispensing plate 140 and terminates in a rounded upper surface with radius $R^1$, or a projection such as projection 179*b* in FIG. 29*d*, which extends a height $H^1$ above the upper surface 142 of the dispensing plate 140. The lower portion of each capillary channel may also terminate in a rounded lower surface with radius $R^2$ as shown in FIG. 29*e*. Each of the capillary channel configurations in FIGS. 29*a*–29*f* may be used in the dispensing plate 140, in order to create a dispensing device with particular liquid cleaner fluid delivery characteristics, i.e. viscosity, thickness, and surface tension. In an alternate embodiment, the capillary plate may comprise a recessed cavity in which is placed a sintered porous plastic pad which may also serve as a wicking device.

Referring again to FIG. 28, it can be seen that the dispensing plate 140 also has two features which serve to limit the uptake of flush water into the bottle 118, by way of the collecting cavity 144. First, the dispensing plate 140 includes at least one barrier wall 154 surrounding a portion of the collecting cavity 144. These barrier walls 154 prevent water from entering the collecting cavity 144 from the sides and the rear of the collecting cavity. Second, the dispensing plate 140 includes a pair of drain conduits 152, extending through the dispensing plate 140. The drain conduits 152 function drain water from the area of the dispensing plate 140 near barrier walls 154. In addition, notches or openings 188 are cut in the riser, 187, below the bottom or lower wall 186 of the feed conduit 131, so as to improve flow of liquid from the dispensing hole 138 over the surface 142 of the base 124, via channels 148. Selective removal of portions of the front and sides of the riser of the bottom wall, i.e. cutting notches or openings, has been found to aid in the venting of the bottle and draining of excess water away from the dispenser.

Figure 24:
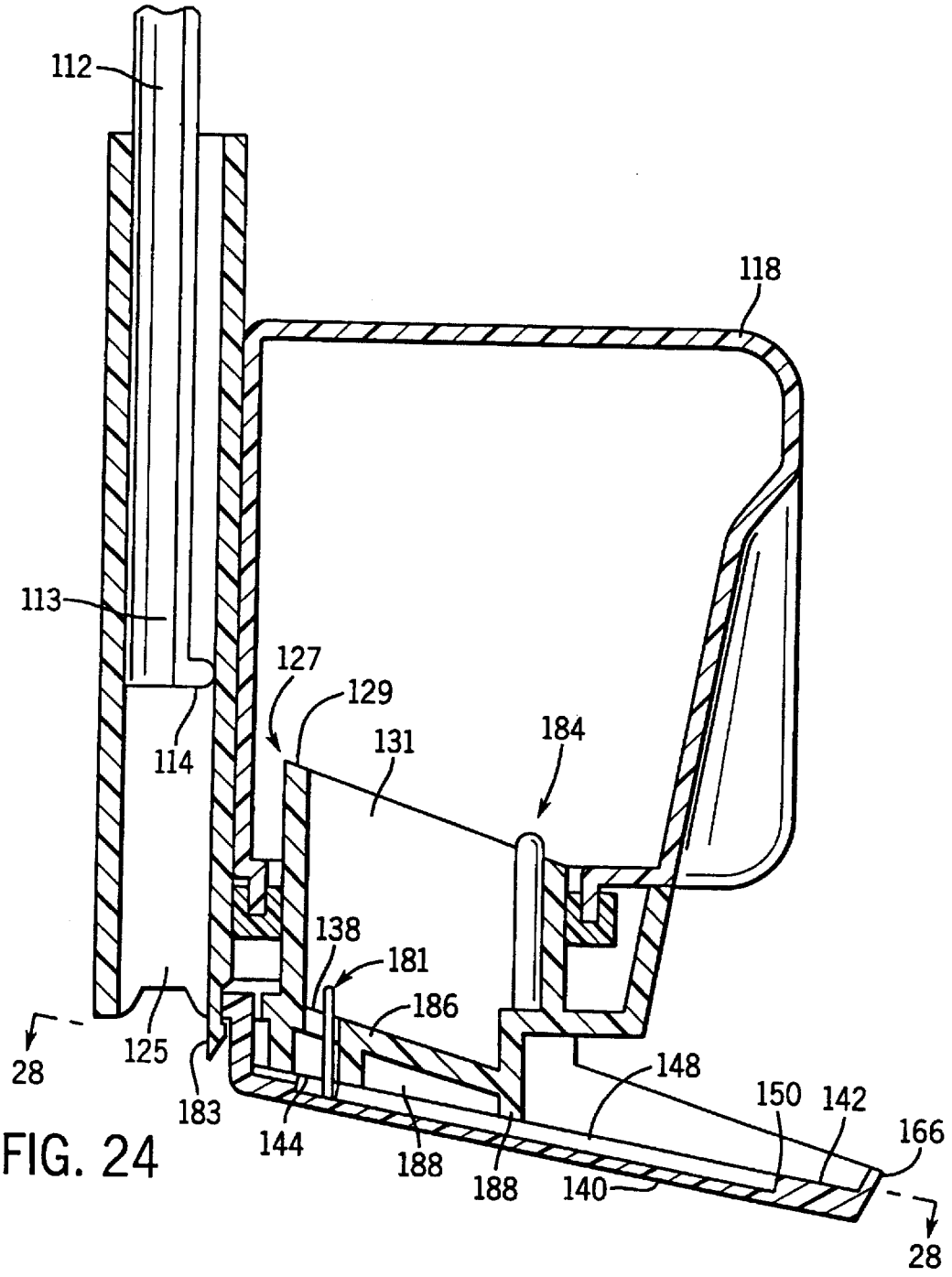
FIG. 24 is a cross-sectional view taken along line 24—24 of FIG. 18.

Turning now to FIG. 24, the positioning of the dispensing plate 140 with respect to the other structures of the base 124 is best shown. The dispensing plate 140 is attached, either as a separate step or as part of the molding of the base, such that the collecting cavity 144 of the dispensing plate is placed in fluid communication with the feed conduit 131 of insert 193. In the version shown in FIG. 24, the dispensing hole 138 at the bottom of the piercing post 127 provides a fluid path between feed conduit 131 and the collecting cavity. As a result of this configuration, liquid flows from bottle 118, into feed conduit 131 of base 124, through the dispensing hole 138 and into the collecting cavity 144 of the dispensing plate 140. The liquid then flows from the collecting cavity 144 into the capillary channels 148 in the upper surface 142 of the dispensing plate 140. The liquid then continues toward the outer end 150 of the capillary channels 148, where the liquid is dispensed to the toilet with the flush water as will be hereinafter described.

The dispensing plate 140 may also include a vertical post 181, extending upward from the dispensing plate 140 into the dispensing hole 138 and feed conduit 131, for the purpose of breaking the surface tension of the liquid being dispensed, and thereby improving flow characteristics thereof. As illustrated in FIGS. 24 and 25, the surface tension breaking post 181 may preferably, but not necessarily, be centered in dispensing hole 138, and may rise a short distance above the surface of lower wall 186.

Various means may be used to move the liquid from collecting cavity 144 of the dispensing plate through the capillary channels to the outer end 150 of the channels. First, the capillary action provided by adherence of the fluid to the sides of the channels 148 will move the liquid toward the outer ends thereof. Moreover, the channels 148 may have a depth greater than the depth of the collecting cavity 144, which serves to move the liquid toward the outer end of the capillary channels. And preferably, the dispensing plate 140 is inclined downwardly, at an angle of from about 10 to about 30 degrees from the horizontal, such that the collecting cavity 144 is higher than the outer ends 150 of the capillary channels. Of course, each of these method of controlling liquid flow from the collecting cavity 144 into and through the capillary channels to the outer most areas 150 thereof may be used alone or in conjunction with the other methods.

Figure 30:
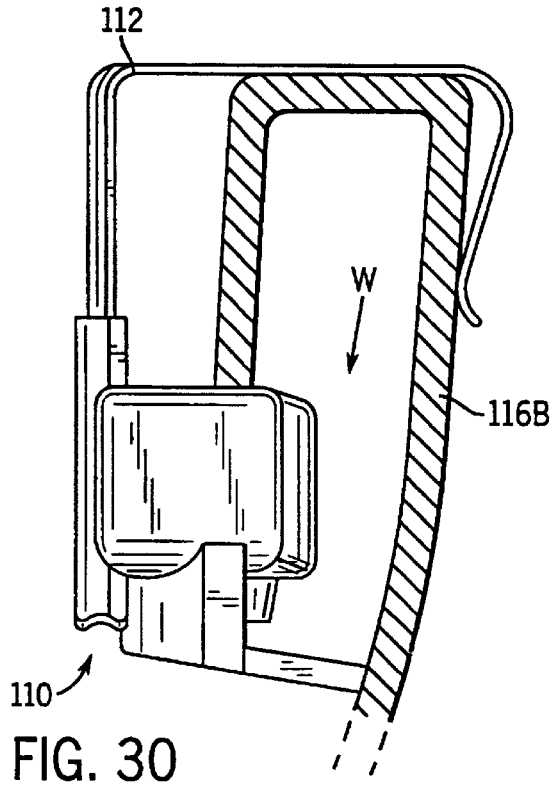
FIG. 30 is a schematic sectional view of a liquid dispensing device in accordance with the invention installed on an open rim type toilet bowl.
Figure 31:
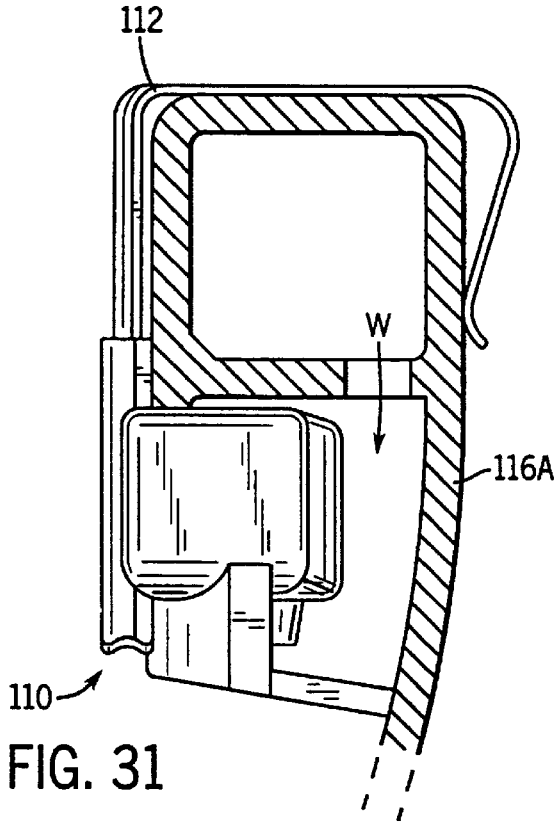
FIG. 31 is a schematic sectional view of a liquid dispensing device in accordance with the invention installed on a boxed rim type toilet bowl.

Having described the means for moving liquid from the bottle 118 to a position on the upper surface 142 of the dispensing plate 140, the use of the liquid dispensing device 110 may now be described by reference to FIGS. 30 and 31. FIG. 30 illustrates the configuration of a liquid dispensing device 110 when used in conjunction with a toilet 116B, having an open rim. With the liquid dispensing device 110 suspended from the rim, it can be seen that the stream of flushing water, W, will contact the dispensing plate 140 with each flush, carrying fluid from the upper surface 142 of the dispensing plate 140 into the bowl of the toilet. Similarly, FIG. 31 illustrates the configuration of a liquid dispensing device 110 used in conjunction with a toilet 116A having a box rim. With the liquid dispensing device 110 suspended from the rim of toilet 116A, it can be seen that the stream of flushing water W will also contact the dispensing plate 140 with each flush. When the flushing water contacts the dispensing plate 140, the flush water mixes with the liquid present in the capillary channels 148 on the upper surface 142 of the dispensing plate 140, and is then distributed into the toilet bowl. After the flushing water washes liquid from the dispensing portion of the dispensing plate 140 into the toilet water, a fresh supply of liquid is distributed from the bottle 118 to the capillary channels 148 as described herein. In order to allow air to vent into the bottle 118 when liquid is dispensed onto the dispensing plate, there is provided a venting slot 146, shown best in FIG. 28, in the upper surface 142 of the dispensing plate 140 and through the rear edge 143 of the plate. This venting slot 146 provides a path between the collecting cavity 144 and the atmosphere to permit ambient air to enter the bottle 118, to displace liquid dispensed therefrom.

The use of the capillary dispensing channels implemented in the liquid dispensers 10 and 110 in accordance with the invention provides a linear and consistent amount of liquid to the flush water. One embodiment of the liquid dispenser is designed to last approximately one month, in average usage, providing consistent foaming, cleaning, disinfecting, and fragrancing at each flush, from the first to the last. It has been discovered that the use of capillary channels on the dispensing plate, as disclosed, is very significant in delivery of a steady level of fragrance between flushes as the surface area of the capillary channels insures that adequate fragrance is delivered to the atmosphere after each flush.

One skilled in the art will appreciate that the present invention can be practiced by other than the preferred embodiments, which have been presented for purposes of illustration and not of limitation. For example, the liquid dispensing device may be used to dispense liquids in locations other than the rim of a toilet bowl (e.g., a bathtub). Therefore, the scope of the appended claims should not be limited to the description of the preferred embodiments contained herein.

Industrial Applicability

The invention may be used to dispense liquids from a reservoir or bottle, and in particular may be used to dispense quantities cleaning and/or freshening liquids from the rim of a toilet bowl.

What is claimed is:

1. A liquid dispensing device for suspension from a support, the device comprising:

a bottle for holding a liquid, the bottle having a mouth and a closure covering the mouth;

mounting structure for holding the bottle, the mounting structure having a piercing post defining a feed conduit having, in use, a bottom wall, means for opening the closure of the bottle and for placing the feed conduit in fluid communication with the mouth of the bottle, and a dispensing plate; and suspension means for suspending the mounting structure from the support;

wherein the dispensing plate has, in use, an upper surface having a collecting cavity in fluid communication with the feed conduit and in fluid communication with a plurality of feed channels in said dispensing plate, said feed channels being suitable to convey the liquid from the collecting cavity to a dispensing position, which, in use, is on the upper surface of the dispensing plate, said dispensing plate being, in use, downwardly inclined at an angle of at least 5 degrees from the horizontal.

2. The liquid dispensing device of claim 1, wherein:

the suspension means comprise a suspension hook and a guide channel in the mounting structure, the suspension hook having a lower end, the suspension hook being slidably inserted in the guide channel such that the lower end of the suspension hook engages an inner surface of the guide channel.

3. The liquid dispensing device of claim 1, wherein:

the piercing post has a cylindrical tubular section, and the means for opening the closure of the bottle comprises an obliquely truncated end portion of the tubular section.

4. The liquid dispensing device of claim 1, wherein:

the closure of the bottle comprises a frangible seal configured to be broken by pressing against the end portion of said piercing post.

5. The liquid dispensing device of claim 4, wherein:

the mounting structure further comprises means for keeping at least a section of said frangible seal off of the end portion of the piercing post after said frangible seal is broken.

6. The liquid dispensing device of claim 5, wherein:

said means for keeping at least a section of the frangible seal off of the end portion of the piercing post comprises a projection that extends above the end portion of the piercing post.

7. The liquid dispensing device of claim 1, wherein:

said mounting structure holds and supports said bottle in an inverted position with the mouth of said bottle projecting downwardly, in use, so as to dispense liquid from said bottle by gravity.

8. The liquid dispensing device of claim 7, wherein:

said feed conduit is surrounded by an annular channel having an outer cylindrical wall, the interior of which wall engages the outer surface of the mouth of said bottle, said wall further providing a plurality of means for engaging said dispensing plate, and said dispensing plate, in use, is downwardly inclined at an angle of from about 5 to about 20 degrees from the horizontal.

9. The liquid dispensing device of claim 1, wherein:

said dispensing plate, in use, is downwardly inclined at an angle of from about 20 to about 30 degrees from the horizontal, and said dispensing plate is spaced apart from the bottom wall of said feed conduit by a riser, said riser having openings therein to permit venting of said bottle.

10. The liquid dispensing device of claim 9, wherein:

said dispensing plate further comprises at least one barrier wall surrounding at least a portion of said collecting cavity.

11. The liquid dispensing device of claim 10, wherein:

said dispensing plate further comprises at least one drain conduit for draining water from said dispensing plate in the area of said at least one barrier wall.

12. The liquid dispensing device of claim 10, wherein:

said dispensing plate further comprises a venting slot whereby atmospheric air may enter said bottle to displace liquid dispensed therefrom into the flushing water.

13. The liquid dispensing device of claim 10, wherein:

said dispensing plate further comprises a vertical post which, in use, extends vertically into the dispensing hole of said bottom wail of said feed conduit to break the surface tension of the liquid being dispensed.

14. The liquid dispensing device of claim 1, wherein:

said dispensing plate, in use, is inclined downwardly from said collecting cavity to said dispensing position at an angle of from about 10 to 30 degrees from the horizontal, and said liquid has a viscosity of from about 2000 to about 4000 centipoise.

15. The liquid dispensing device of claim 14, wherein:

said feed channels radiate outwardly from said collecting cavity.

16. The liquid dispensing device of claim 15, wherein:

at least a portion of the feed channels have a depth greater than the depth of the collecting cavity.

17. The liquid dispensing device of claim 16, wherein:

said dispensing plate further comprises at least one barrier wall surrounding at least a portion of said collecting cavity.

18. The liquid dispensing device of claim 17, wherein:

said dispensing plate further comprises at least one drain conduit for draining water from said dispensing plate in the area of said at least one barrier wall.

19. The liquid dispensing device of claim 18, wherein:

said dispensing plate further comprises a venting slot whereby atmospheric air may enter said bottle to displace liquid dispensed therefrom into the flushing water.

20. The liquid dispensing device of claim 19, wherein:

said dispensing plate further comprises a vertical post which, in use, extends vertically into the dispensing hole of said bottom wall of said feed conduit to break the surface tension of the liquid being dispensed.

21. The liquid dispensing device of claim 20, wherein:

said bottle has a view stripe which, in use, extends vertically on a portion of the bottle, the view stripe being suitable for transmitting light from outside the bottle to inside the bottle.

22. The liquid dispensing device of claim 21, wherein:

the device is a dispenser for dispensing liquid from the rim of a toilet bowl.

23. The liquid dispensing device of claim 22, wherein:

said dispensing plate includes a rim at the perimeter thereof.

24. A device for dispensing a liquid from the rim of a toilet bowl, the device comprising:

a bottle for holding a liquid cleaning agent, the bottle having a mouth and a closure for covering the mouth;

mounting structure for holding said bottle, said structure comprising a piercing post defining a feed conduit, said piercing post suitable for opening the closure of the bottle and establishing fluid communication between the mouth of the bottle and the feed conduit, means for keeping at least a portion of the closure off of the end portion of the piercing post after said closure is opened, and a dispensing plate; and suspension means for suspending the mounting structure from the rim of a toilet bowl;

wherein said dispensing plate is, in use, downwardly inclined at an angle of at least 5 degrees from the horizontal and has, in use, an upper surface having a collecting cavity in fluid communication with said feed conduit and in that the liquid has a viscosity between about 2000 and about 4000 centipoise.

25. The device of claim 24, wherein:

said feed conduit further comprises a plurality of means for engaging said dispensing plate and said dispensing plate comprises a plurality of feed channels, the feed channels being suitable to convey the liquid from said collecting cavity to a dispensing position which, in use, is on the upper surface of the dispensing plate.

26. The device of claim 25, wherein:

said feed conduit is surrounded by an annular channel which engages the mouth of the bottle, the exterior wall of said feed conduit providing at least three means for engagement of said dispensing plate.

27. The device of claim 26, wherein:

the feed conduit comprises a lower wall having a dispensing hole therein, said lower wall spaced from said dispensing plate by a riser having openings therein to permit venting of said bottle, and said dispensing plate is, in use, downwardly inclined at an angle of from about 10 to about 30 degrees from the horizontal.

28. The device of claim 27, wherein:

said dispensing plate includes at least one barrier wall surrounding at least a portion of the collecting cavity.

29. The device of claim 28, wherein:

the dispensing plate has a surface tension breaking post which, in use, extends upward from the collecting cavity into the feed conduit.

30. The device of claim 29, wherein:

the dispensing plate includes a rim at the perimeter thereof, and at least one drain conduit extending through the dispensing plate for draining water from said dispensing plate in the area of said at least one barrier wall.

31. The device of claim 30, wherein:

said dispensing plate further comprises a venting slot whereby atmospheric air may enter said bottle to displace liquid dispensed therefrom into the flushing water.

32. The device of claim 31, wherein:

said dispensing plate further comprises a vertical post which, in use, extends vertically into the dispensing hole of said bottom wall of said feed conduit to break the surface tension of the liquid being dispensed.

33. The device of claim 32, wherein:

said bottle has a view stripe which, in use, extends vertically on a portion of the bottle, the view stripe being suitable for transmitting light from outside the bottle to inside the bottle.

34. The device of claim 33, wherein:

at least a portion of the feed channels have a lower surface that is, in use, inclined downwardly with respect to a lower surface of the collecting cavity.

35. The device of claim 29, wherein:

the dispensing plate includes a deflector secured to an edge of the dispensing plate, the deflector being dimensioned so as to be suitable to contact an inner surface of the toilet bowl when the device is installed on the rim of the toilet bowl, and said dispensing plate is, in use, downwardly inclined at an angle of from about 20 to about 30 degrees from the horizontal.

* * * * *